United States Patent [19]

Henkel

[11] Patent Number: 4,651,995

[45] Date of Patent: Mar. 24, 1987

[54] MULTIPLE CARD BINGO GAME PLAYING DEVICE

[75] Inventor: William K. Henkel, Fairport Harbor, Ohio

[73] Assignee: Bingold Ventures, Kirtland, Ohio

[21] Appl. No.: 853,364

[22] Filed: Apr. 15, 1986

Related U.S. Application Data

[63] Continuation of Ser. No. 580,115, Feb. 14, 1984, abandoned.

[51] Int. Cl.[4] ..... A63F 3/06

[52] U.S. Cl. ..... 273/237; 273/269

[58] Field of Search ..... 273/121 A, 138 A, 237, 273/238, 269; 364/410–412

[56] References Cited

U.S. PATENT DOCUMENTS

| | | | |
|---|---|---|---|
| 4,312,511 | 1/1982 | Jullien | 273/269 |
| 4,350,340 | 9/1982 | Hall | 273/138 A |
| 4,365,810 | 12/1982 | Richardson | 273/269 |
| 4,378,940 | 4/1983 | Gluz et al. | 273/269 |
| 4,448,417 | 5/1984 | Clark et al. | 273/121 A |
| 4,455,025 | 6/1984 | Itkis | 273/269 |
| 4,475,157 | 10/1984 | Bolan | 273/237 |

*Primary Examiner*—Richard C. Pinkham
*Assistant Examiner*—MaryAnn Stoll Lastova
*Attorney, Agent, or Firm*—Donald A. Teare

[57] ABSTRACT

A game device for simultaneously playing a plurality of bingo cards. The hittable numbers from a plurality of cards are input by keys for storage and displayed in the same spatial relationship in which they appear on the cards. The patterns of the game to be played are programmed by the player and displayed in their spatial relationship. Random numbers, called by the M.C., are entered and processed. When a bingo or alert is found, lamps indicative of the status are lit. When a card is 1 short of a bingo, each number needed for bingo is displayed. On achieving a bingo, each winning combination is displayed.

6 Claims, 27 Drawing Figures

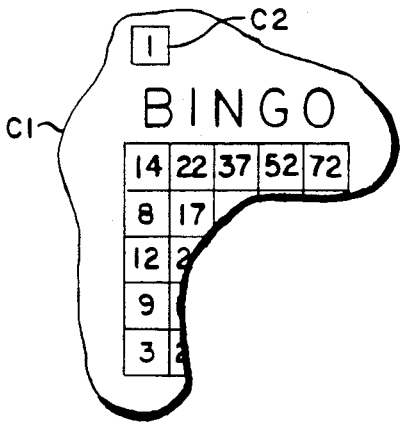
FIG. 1-A
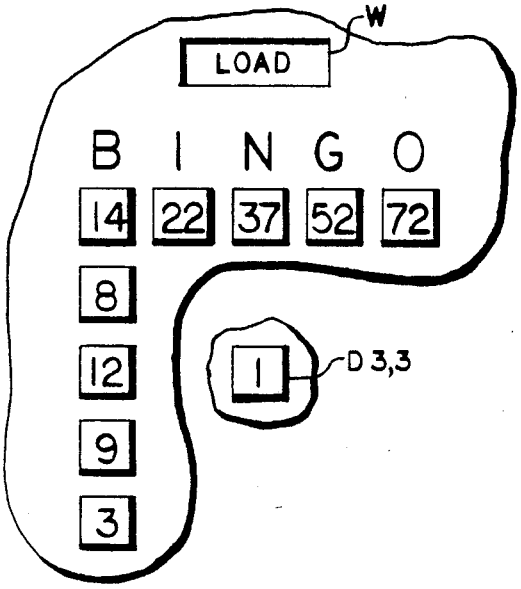
FIG. 1-B
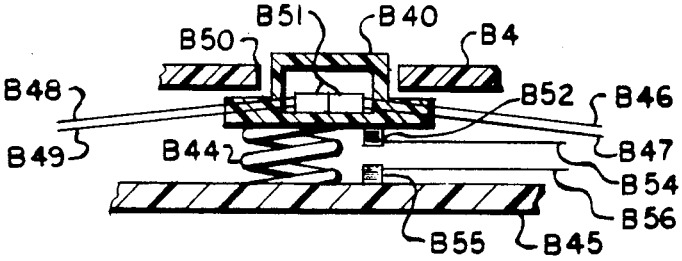
FIG. 1-C

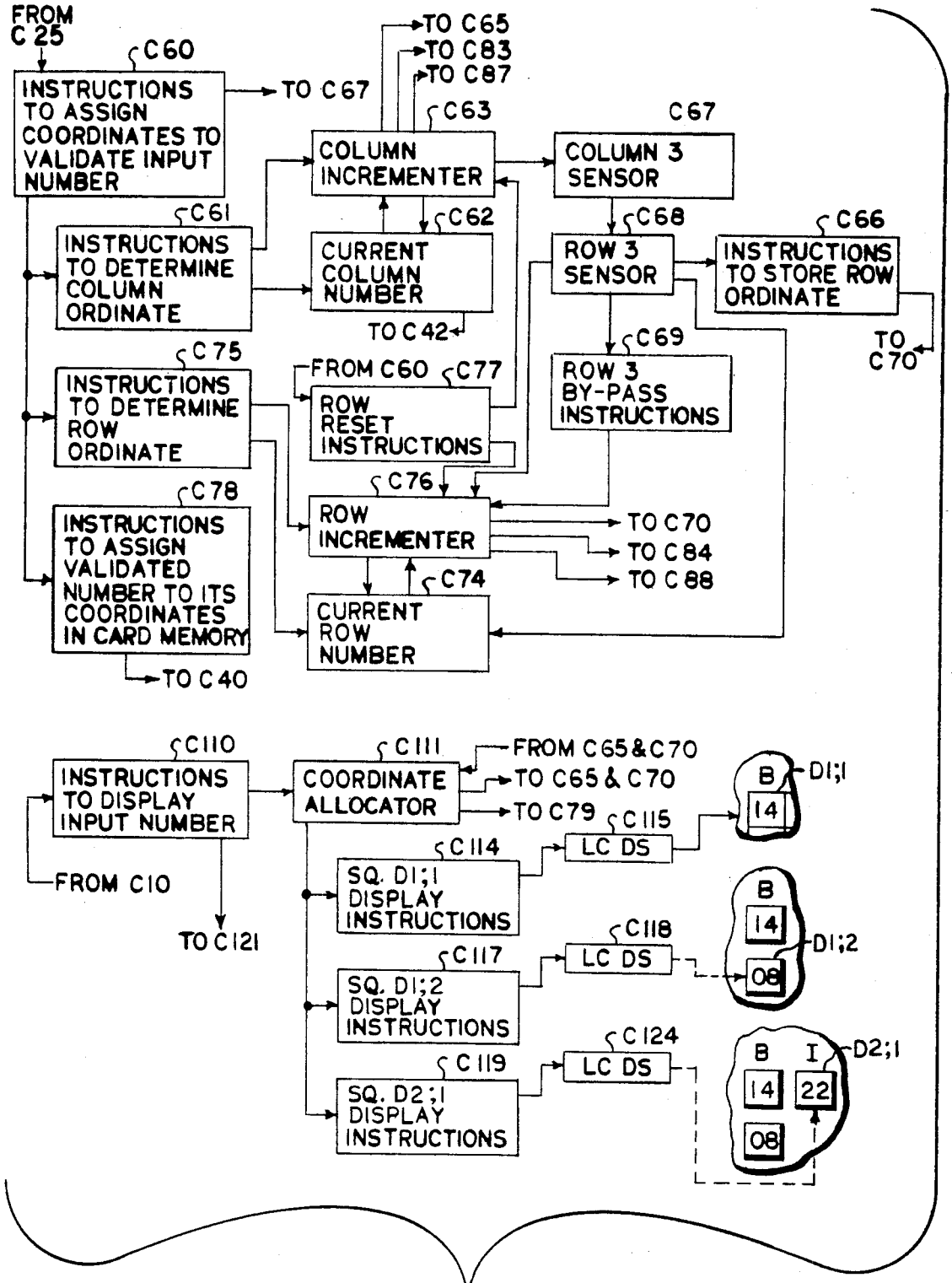
FIG. 2-A

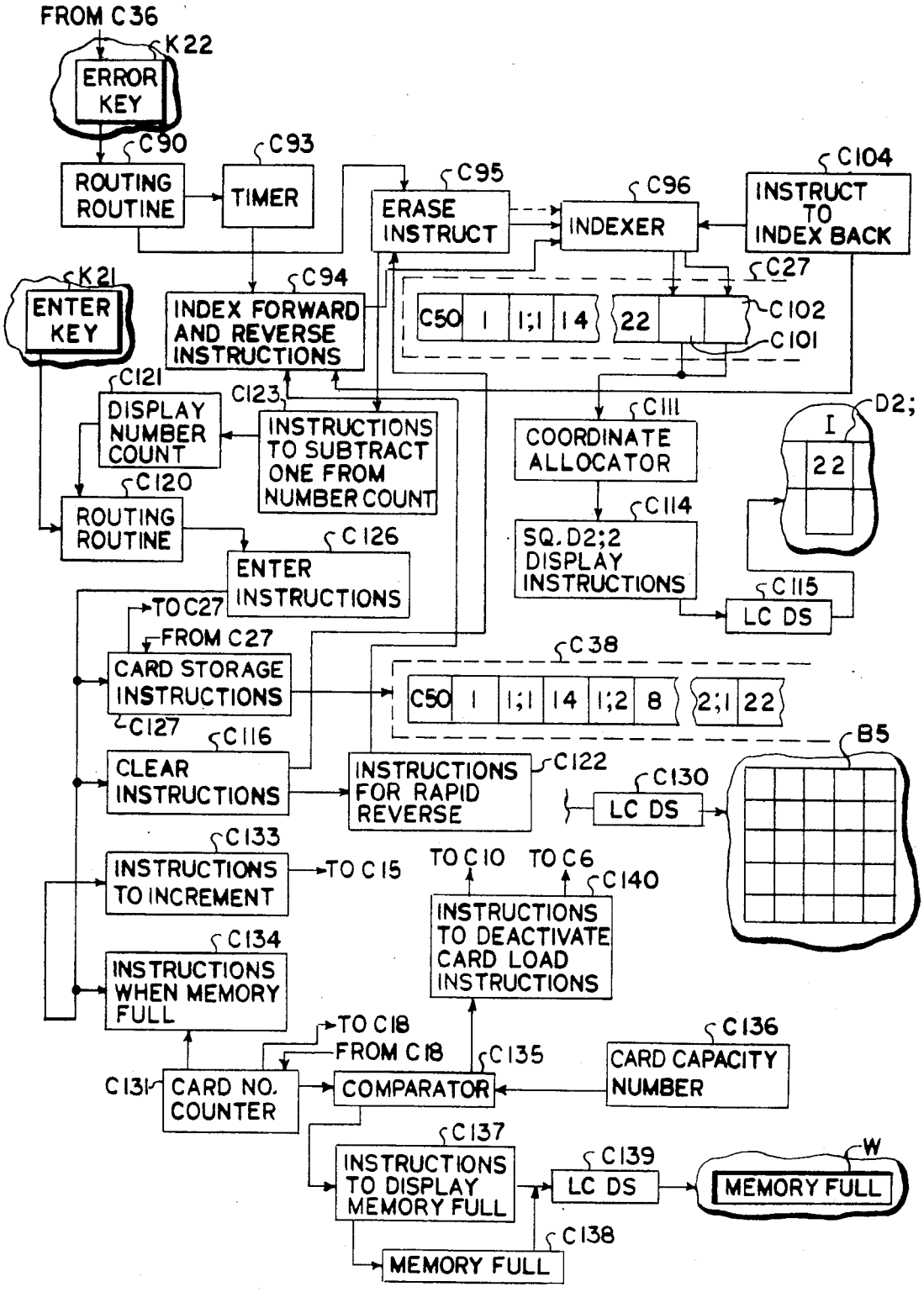
FIG. 2-B

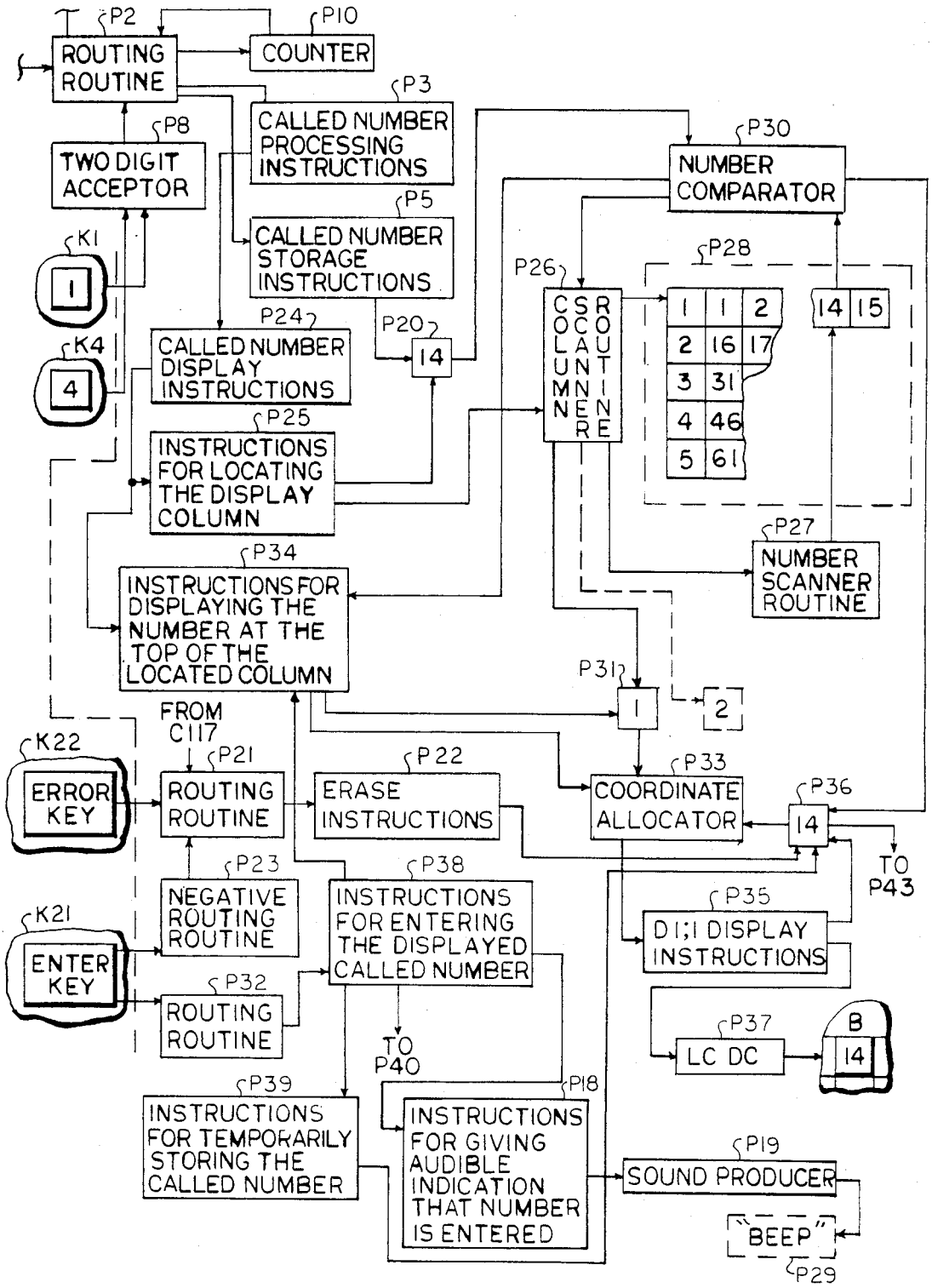
FIG.4-A

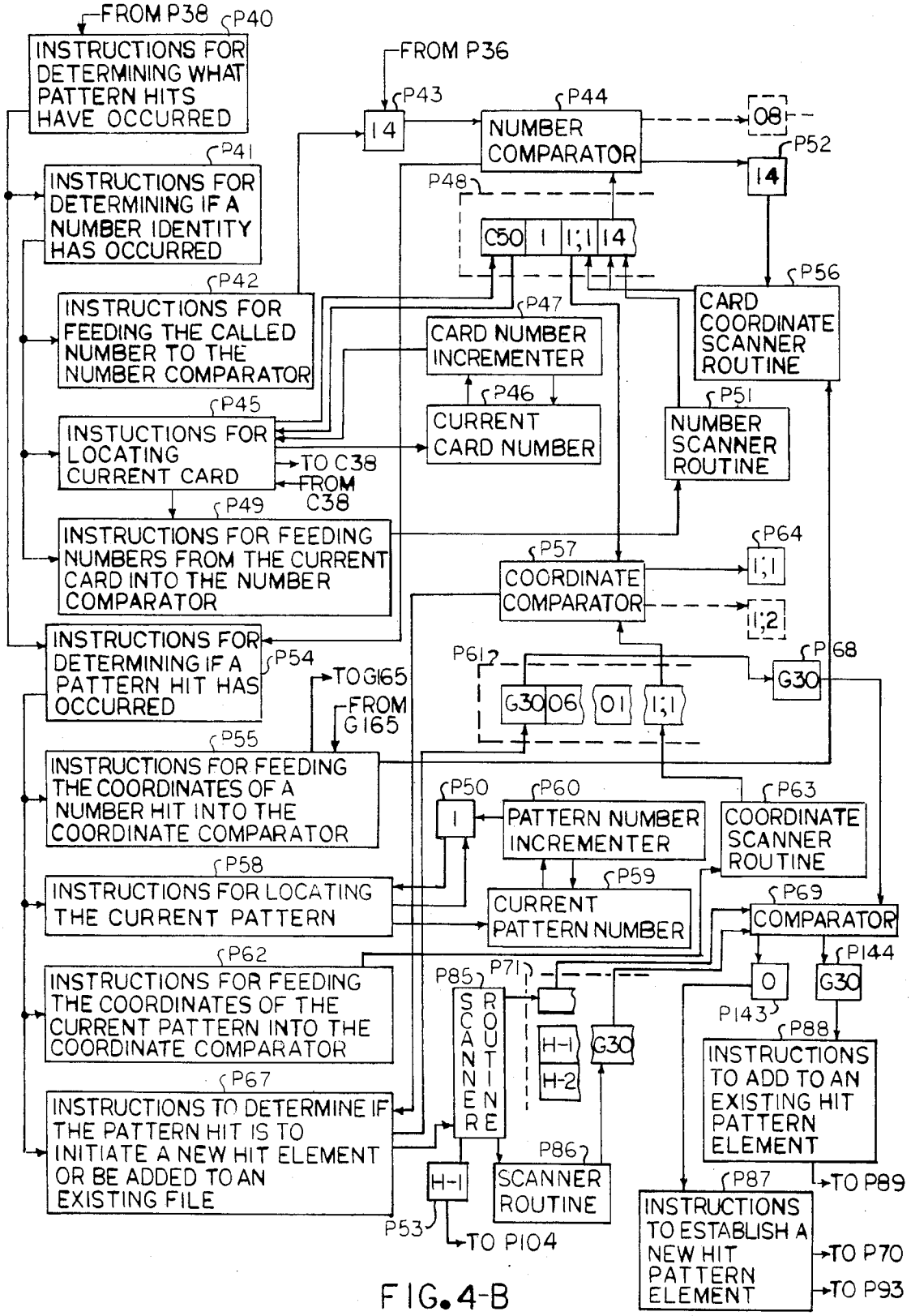
FIG. 4-B

MULTIPLE CARD BINGO GAME PLAYING DEVICE

This is a continuation of application Ser. No. 580,115 filed on 2-14-84, now abandoned.

BACKGROUND OF THE INVENTION

The present invention relates to a device for enhancing the pleasure, enjoyment, availability and accuracy of playing Bingo simultaneously on a plurality of bingo cards, and more particularly to a visual display game playing device.

Modern Bingo has come a long way from the simple one-type of game which was simple to play, but also somewhat dull. When Bingo is played today, the player must be able to cope with a variety of frequently changed games from straight bingo to exotic forms, all in one session and, to make matters even more difficult, playing several cards simultaneously, usually in a crowded and often noisy room where there are many distractions. Under such conditions not only must the player at all times be aware of which of the many possible games is being played at the moment, so that he can react promptly and correctly, he must also rapidly scan and make his moves on a plurality of cards in a remarkably short time before the next number is called. The player must perform these feats of mental agility under conditions which, on the one hand, foster confusion and, on the other hand, as play is prolonged, generate a numbing of the mind, or boredom—all of which make accurate play extremely difficult.

Still another problem is one of inadequate space. In the locale where the session is held, there usually is not enough room on a table to keep track of all the cards conveniently. As a result, a player is restricted in the number of cards he can play, or he has the difficult task of laying cards on top of cards, with subsequent difficulty in spotting bingos thereon, and even of erroneously shifting some hit indications in shuffling the cards, thereby adding to the confusion and the potential for error.

An additional problem relates to the complexity of a bingo card, which complexity is compounded when playing several cards simultaneously.

As a result of the foregoing difficulties, the player may miss a bingo to which he is entitled, or he may erroneously think that he has a bingo and suffer the embarassment of going up to the M.C. table after he has stopped all play by crying out "Bingo", only to find that he has a false bingo due to his inaccurate marking of the cards.

Even if a player is able to accurately hear all the numbers and correctly mark his cards, during the opening portion of the session, as time goes on the soporiphic effect of the constant calling of numbers lulls him into a state where his mind wanders, and a number is missed. Moreover, the strain of having to maintain vigilance causes the player to lose out on the real excitement and thrill of the game.

Moreover, it is difficult, if not impossible for a blind person to play multiple card bingo.

While the present invention contemplates the use of a microprocessor, the use of an ordinary computer presents several problems. A major problem relates to the intended user—the average bingo player. Generally speaking, such player is not trained in the language of computers, and some may even be totally adverse to the computations and numbers involved. Such player is unwilling to engage in a prolonged and difficult learning process, and naturally shies away from anything as abstract as a computer, or that involves complicated mental gymnastics.

Still another problem with the use of a conventional computer, without the unique display of the present invention, is that a conventional computer, with its complexity, distracts from the fun of the play. Yet many people play primarily for fun and excitement. Therefore a playing or progress monitoring aid must not be so abstract and dry that it is boring or dull. One should be able to concentrate on playing, rather than keeping score. But an ordinary computer, without the unique display correlation of the present invention, would take much of the fun out of playing.

Another problem is that the number of game variations is sufficient that it is impractical to program all the possible game variations at the factory. Not only would valuable memory spaces be used for games that the user might not need to play in his locale, but the device then becomes much like a laundry list, with too many numbers and codes for the device to have the practicality of the device of the present invention. Moreover, programming on the spot by the use of an ordinary computer is beyond the skill, or desire, of the ordinary player.

Still another problem with all computers is that they are useless if the input is inaccurate. In the use of a conventional computer in the adverse conditions of a bingo session, the chances of input error would be great, irrespective of how well the computer can handle the information once it is input by the player. In fact, it is to the minimization of input error that one of the most important aspects of the present invention is directed—unique visual display correlated with ease of input.

BRIEF SUMMARY OF THE INVENTION

The device of the present invention provides a unique combination of visual display with easy input of data for loading coded replicas of many bingo cards, which enables the player to program his own games, and to play a variety of games, with each game being played simultaneously on a plurality of cards, with the presence of a bingo and the proximity thereto being uniquely indicated.

The device provides for a correlation by a computer between the spatial and numerical information derived from bingo cards to be played, with a variety of spatially oriented game patterns, and the random input of numbers called by the M.C., with unique visual display, facilitating the rapid and accurate input of data, and monitoring the progress of the play.

In one embodiment, the hittable numbers of a plurality of cards are automatically displayed in the same spatial correlation as exists on the cards.

In another embodiment, the player can program his own games by the easy means of inputting spatial patterns for the game to be played, with the patterns automatically being displayed for enhancing the accuracy of input.

In another embodiment, the player only inputs the random numbers of letter-number combinations, and the device displays the numbers on a grid in a column associated with such letters by the conventions of bingo.

In still another embodiment, progressively lighted lamps signal the progress of the player towards bingo.

In another embodiment, when a card is one number short of bingo in any of its bingo pattern combinations, the number needed to complete a bingo for such card is displayed on the display grid in the same column associated with the number by the conventions of bingo.

In another embodiment, any card can be selected, and the hittable numbers needed for bingo on such card displayed.

In another embodiment, each winning card number is displayed. Moreover, the winning group of numbers in the same pattern in which they appear on the winning card, are also displayed.

In still another embodiment, an optical reader provides the input means for inputting the hittable numbers from the cards to be played into the device.

In another embodiment, a voice synthesizer, and audio output means, such as ear plugs or a loud speaker, provide at least one form of output for the device.

By the present invention, a novel device is provided which overcomes the shortcomings of the conventional play of bingo, or of the use of an ordinary computer as an aid. Such objective is accomplished by the provision of a device which is enjoyable to use and easy to play, which increases rather than detracts from the fun of playing the game, which dramatically increases the accuracy of input, which allows for maximum concentration, which overcomes boredom and confusion alike, which provides for the accurate playing of many cards at the same time, which minimizes the embarassment of a false calling of "Bingo", which is attractive even to the computer-phobic or computer untrained person, and which can increase the number of people who could play bingo—including the blind.

BRIEF DESCRIPTION OF THE DRAWINGS

FIG. 1A is a fragmentary top plan view of a bingo card;

FIG. 1B is a fragmentary top plan view of a portion of the display grid of the device of FIG. 1, illustrating the display of the hittable numbers of the bingo card of FIG. 1A in the same spatial relation in which the hittable numbers appear on the card;

FIG. 1C is a fragmentary cross sectional view of a display and program key mounting, taken along the line 1C—1C in FIG. 1, illustrating a structure for combined display and input;

FIG. 2A is a partially fragmentary and partially schematic view of a portion of the Load Mode, illustrating the display of the input numbers in columns corresponding to the letters with which such numbers are associated by the rules of bingo;

FIG. 2B is a partially fragmentary and partially schematic view of a portion of the Load Mode, illustrating error correction of the displayed number, the entry of the displayed number into permanent memory, the clearing of the screen, the displaying of a "memory full" indications, where applicable, and the instructions to increment to the next number, where applicable.

FIGS. 3B to 3E are partially fragmentary and partially schematic views of a portion of the Program Mode illustrating the input and display of pattern numbers 2 to 4 to provide the completion of programming of the game shown;

FIG. 4A is a partially fragmentary and partially schematic view of the input of a called number, the display of the number at the top of the column below the letter which is associated with the number in accordance with the rules of bingo, error means for erasing the number if it is erroneous, and means to enter the number for further processing if the displayed number is seen to be in correct, and the production of an audible indication that the displayed number has been entered, as part of the Play Mode.

FIG. 4B is a schematic view of a portion of the Play Mode illustrating the process of determining what pattern hits, if any, have occurred on the currently examined card;

DETAILED DESCRIPTION OF THE PREFERRED EMBODIMENTS

Figure 1:
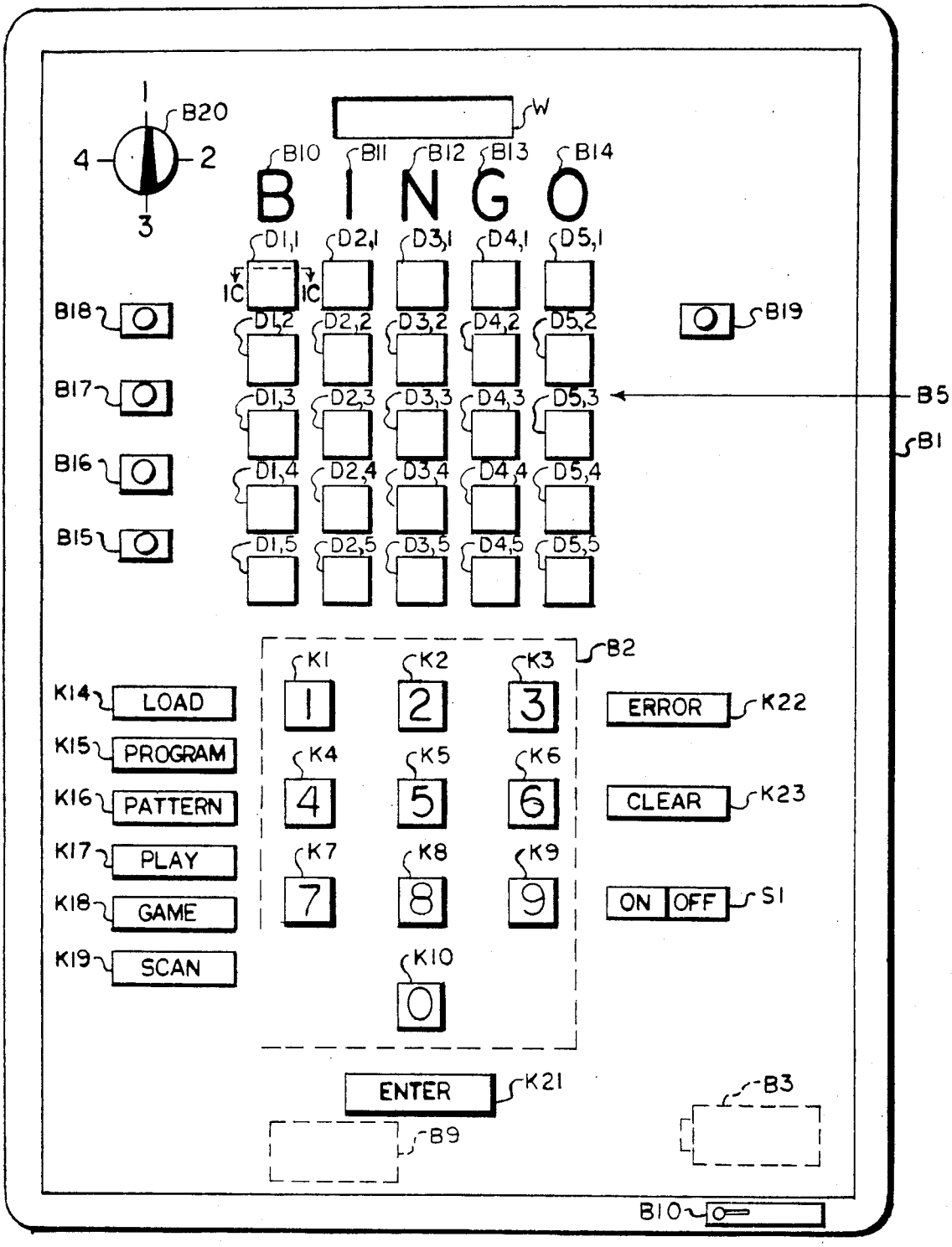
FIG. 1 is a top plan view of a multiple card bingo playing device in accordance with the present invention.

The game, in accordance with the preferred embodiment of the invention, includes a container B1 in which computer means, such as a microprocessor B2, powered by a battery B3 is mounted. In the center of the top surface B4 of the container, below the spaced letters, BINGO, B10–B14, is a multi-function display grid B5 composed of a plurality of squares, D1, 1–D5, 5. These grid squares perform as input keys when the device is in the game selection mode, to allow the user to easily program a game to be played, and to provide a visual display of the operation of the game being selected. Moreover, the grid provides a visual display of the card loading operation to provide for loading accuracy, and a partially automatically and a partially manually selective visual display of the progress of the game on the programmed card replicas as numbers are called by the M.C.

Near the display grid B5 are located several mode Keys K14–K23 for selectively placing the device in a variety of modes, such as the game selection, card loading, and card playing modes which the device goes through in carrying out the objects of the invention.

Below the display grid B5 are a plurality of numerical input keys, K1–K10 to allow the player to input numbers related to each of the modes of operation.

A display window W supplements the information functions of the display grid.

All of the above components are electrically connected to the microprocessor B2 to provide a combined manually, automatically, and visually coordinated device for producing the objects of the invention in an easy to use, accurate, rapid and enjoyable manner.

The casing B1 for the game is made of a suitable plastic material, and encloses the microprocessor and battery. The removable top face, or surface, B4 has suitable apertures B6 through which the keys and display elements project. The letters, BINGO, B10–B14 are molded above the display grid B5 in a spaced manner so that each column of the display grid is headed by one of the letters to provide a visual letter-number correlation for accuracy of input.

A plurality of lamps B15–B18, of different colors, such as blue, green, orange, and yellow, respectively, are mounted on the surface B4, and controlled by the microprocessor B2 to provide a progressive series of alerts as to the progress of the Player towards Bingo. A rotary switch B20 provides the selection of the alerts.

A red lamp B19 is mounted on surface B4 and, when lit, indicates the presence of a Bingo. A beeper B9 provides an audible signal that a called number has been entered by the player.

The container B1 has various suitable internal compartments and pedestals (not shown) for containing the various microprocessor components and mounting the input keys, the Liquid Crystal Displays (LCDs) and the other components, as is well known in the art. The power supply for the device is provided by a battery B3, which may be a rechargeable battery, and which is mounted conventionally in a small compartment on the walls of which are conventional contacts for electrically connecting the battery to the microprocessor and other electrically actuated components, such as the lamps (such compartment and contacts not shown). Convenient access to the battery B3 is provided by an access door B10. An on-off switch S1 is mounted on the top face B4 of the casing for electrically switching the device on and off.

The mode keys K14–K23, and the number keys K1–K10, are disposed in conventional spring biased mountings (not shown) inside the casing B1 and are connected so as to close electrical contacts (not shown) to provide input pulses to the microprocessor B2, as is well known in the art.

The microprocessor B2 can be a type such as an Intel 8086 chip which is preprogrammed to perform the usual memory, arithmetic, and control functions, with conventional input and output capabilities. The microprocessor will be securely mounted in the casing B1, and have the conventional electrical connections to the input and output devices and to the power supply. The microprocessor B2 should have a Read Only Memory for all of the operations set forth hereinafter, except for those relating to programming or other input to be performed by the Player. For such operations, the microprocessor should have a Random Access Memory.

Reference will be made in this application to a particular key, such as key K8, which, when pressed inputs the "number 8", or stores a number, such as the "number 8", when in actuality it is a string of binary digits utilizing one of the commonly employed codes such as ASCII or EBCDIC as a representation of the number or letter, rather than the number or letter itself.

Reference will also be made to a 2-digit acceptor. This is an arrangement of elements, which will emit a signal, or give an indication that the next step is to be taken, only when two digits have been entered. This could be a standard routine in ROM that is part of the keyboard input handling code that requires that two digits be entered from the number keyboard for any number to be accepted for processing. Accordingly, where the number to be input has only one digit, such as the number 8, the player presses key K10, the 0 key first, and the 2-digit acceptor then treats such number as a two digit number, with the value of 8, as is well known in the computer art.

Each of the display devices (window W and the plurality of display squares, D1, 1 to D5, 5, which make up the display grid B5) is equipped with some means to provide an alphanumeric readout display. While LCDs (Liquid Crystal Devices) are shown and described, it is to be understood that other readout devices could be used, such as LEDs, if appropriate. It will be understood by one skilled in the art that an appropriate number of readout devices, such as LCDs will be placed adjacent the top surface of the readout element to achieve the numbers or letters shown and described, and that the surface chosen for the window or display square will be transparent and translucent.

It will be further understood that means (not shown) but well known in the art is provided for actuating the Liquid Crystal Displays in accordance with the instructions provided by the applicable routines.

In describing the operations herein, in order to explain in graphic form the interaction of the mechanical input steps performed by the player, the computational steps performed by the microprocessor, and the visual correlation for the input by the player, and enjoyment and facilitation of use, the operations of the computer are described in a rudimentary fashion so that such correlation may be seen. It is obvious to one of ordinary skill in the art, that the commercial embodiment of the device would condense and economize in carrying out the operations of the computer. For example, where several operations are performed herein, the commercial embodiment might combine such several operations into one function. For example, a plurality of elements such as "Registers", "Storage Areas". Comparators "Scanner Routines", "Incrementers" and so forth are described in order that the correlation between the input and the visual output can be understood. Depending on the actual microprocessor used, such as the Intel 8086 chip, in order to economize on memory so that all the operations can be performed on as many game variations and on as many cards are possible, such steps would be condensed. For example, where a number is referred to as being stored in several places, in the commercial embodiment it may be stored in only one place, with the program of the particular programmer providing for calling up this number, or deriving it from other data, when needed. Moreover, only one, or a few elements such as a comparator, or incrementer might be employed, with the data to be compared moved into and out the elements and stored and retrieved as well known in the art. What is important is the visual display which facilitates the accuracy of input to the microprocessor, and which coacts with the input and the computations to provide the unique display, rather than the particular programs employed to make the correlation.

Thus, as another example, when a number or character is shown or described as being stored "adjacent" another number or character, it may not be physically so stored, but rather for efficiency of programming and minimization of use of the memory capability, they may be stored elsewhere and called up or derived from other data by a routine when needed.

Other aspects of the operation are so fundamental, or implied, that they are not mentioned herein. For example, when a number is stated to be stored or retrieved, means must exist to give it an address. Because this is so fundamental, such means is not necessarily specifically mentioned, but is implied.

Similarly, in order to prevent the drawings from being too cluttered, the instruction blocks do not necessarily have lines connected to every operation which activates it or functions under its control. For example, it will be obvious to a person of ordinary skill in the art that if a series of operations is initiated by the instruction block, the subsequent steps leading to the conclusion are controlled by such instruction, wherever applicable.

Moreover, sometimes a simplicity of language may be used in a description. For example, when a reference is made to a "number", "letter", or "word" being "transmitted", or activating a routine, or being stored, it is an electrical impulse or energy (or the absence thereof) arranged in a precoded binary manner to be representative of such information that is being transmitted or stored, rather than the information itself, as is well known in the computer art.

Some language is unusual—such as "Scanner Routine". The meaning of the language can be determined from the context. For example, a "Scanner Routine" would be any routine which can search memory for a particular aspect of information, often in a particular sequence. Similarly, the Scanner Routines could be reduced to a simple value in a register or storage location or memory that informs another routine which column or element it is working with.

In the description herein, reference is made to "instructions" or "routines". The particular routine or instruciton can be any programs which are compatible with the manufacturer's particular chip and programming language preference, as is well known in the computer art, but which will carry out the operations to provide the visual displays herein. The microprocessor arrangement of computational and processing elements are merely illustrative to bring out the correlation between the manual input and the visual output.

Reference will be made to a Routing Routine. When function keys, such as the Play, Load, Program and Game Keys are pressed, an initial routine would gain control, and is referred to as a routing routine. Wile more than one Routing Routine is referred to herein, in order to keep the drawings from being cluttered, it is understood that the commercial embodiment would have a single set of routing instructions, rather than the several shown therein.

Permanent memory, as used herein is meant to distinguish from working memory or scratch memory and usually refers to that portion of RAM which the program has declared for storage of completely verified card or program data. If a more permanent memory is desired, a nonvolatile memory or bubble memory could be incorporated for data such as the programmed game pattern data where it is desired to retain such data when the device is turned off.

It is to be understood that where the phrase, "memory location" is used in the text, this is a reference to a particular field, or one of a series of such fields within a storage area, or array, or element of an array, rather than necessarily to a specific address in memory.

In the commercial embodiment there could be one set of display software instructions, instead of one for each grid location illustrated. Such one set of instructions would provide coordinate information and the value of the number to be displayed to a standard LCD display routine, which may be in ROM.

In the commercial embodiment, the "indexer" could be a register or storage location that contains a value denoting the curent position within an array. This would be referenced by one or more routines for purposes of controlling processing.

Moreover, in the commercial embodiment, the counter might initialized to the absolute value of the current grid location, and it would be decrimented by one for each 500 milliseconds that the error key remains depressed, thereby enabling repetitive erase backwards through the display under control of the operator as determined from the coordinates at the current value of the indexer C96.

Load Mode

When a player arrives at a Bingo session, he receives one or more Bingo cards, each of which has a different combination of numbers contained on a 5×5 grid on the face of the card. These numbers are the ppotentially "hittable" numbers, i.e. a hit occurs if a number called by the M.C. matches a number on the card provided, that the number is located on the card within a pattern of a game being played.

Figure 2:
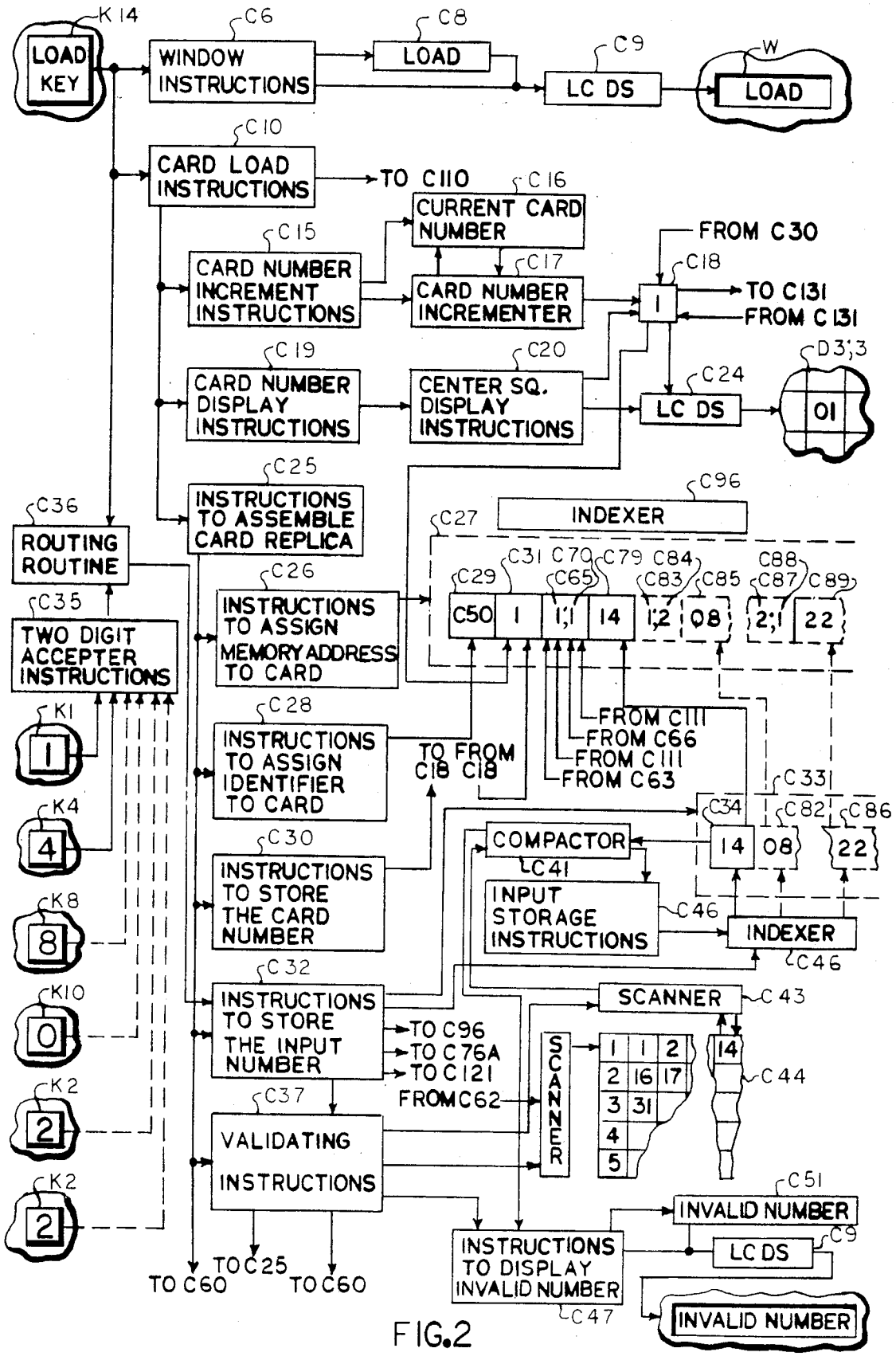
FIG. 2 is a partially fragmentary and partially schematic view of a portion of the Load Mode, illustrating certain input keys, a display of the directions to "Load", a display of the card number being loaded, and validity checking of the input number, and a display of the phrase, "invalid number" if the input number fails the validity check.

In accordance with one aspect of the invention, means is provided to place the machine in a Load Mode to receive and place in memory coded representations of the hittable numbers from the bingo cards he receives, as well as coded representations of the spatial locations of such numbers on the card. Such input of the coded representations is referred to herein, as "loading" of the cards. In the embodiment of FIG. 2, a load key K14 places the device in the Load Mode.

In order to guard against error in assigning consecutive numbers to the cards (so that no two cards will have the same numbers during processing) the machine will automatically assign consecutive numbers, commencing with the number 1. Thus, it is preferred that the player conform the numbering of his cards to the device, rather than visa versa. Accordingly, before pressing the Load Key K14, the player merely places the cards in a stack, and numbers them, such as by a pencil or by a sticker, in sequence, from 1 to as high a number of cards as he receives. As an example, a sticker C2 having the number 1 thereon, is shown placed on a card C1 (FIG. 1A) as an identification of the card. In the preferred embodiment, the player can handle up to 99 cards, although probably, he will prefer to play a maximum of 15–20 cards at a time.

When the load key is pressed, means is provided to indicate to the Player that he is in the Load Mode. Thus, the pressing of the Load Key activates the window display instructions C6, which retrieve the data word, "LOAD", from its memory location C8 to cause the LCDs C9 in the window W to provide a visual indication "LOAD", so that the player is certain that he is in the LOAD, rather than another mode.

As mentioned, the device automatically assigns the number 1 to the first card to be loaded. Thus, the pressing of the Load Key actuates the Card Load Instructions, Routine C10 which, as the first step, generates and displays the number 1 so that the player can be sure that this is the card number being loaded, and check his actual card to verify that the card number 1 is, in fact, the card he is loading, and that he has so marked the card. One way of assigning the number one is for Routine C10 to activate Card Number Incrementing Instructions C15, to bring the number of the current card (in this case zero since the loading is just beginning) from its memory location C16, increment it by 1 in the Card Number Incrementer C17, and place the new number in memory location C18 as well as in C16.

The Card Load Instructions C10 activate the Card Number Display Instructions C19, which, in turn, activate the Center Square Display Instructions C20, which retrieve the current card number from C18 and causes the LCDs C24 to display the number 1 in the grid center square D3, 3 to show the player that card number 1 is being loaded.

It is preferred that the card number is displayed at the center square, as it forms the center of attention, whenever the display grid B5 is viewed, and thus is not easily overlooked. This center position is always available, and will never have a "hittable number", as such square is always a "free square" in bingo, i.e. it always counts towards a BINGO, and thus, conventionally, bingo cards have no number appearing thereon. Accordingly, this square provides a unique location for displaying information to the player about what card he is loading, what game he is programming, what cards have a bingo, and so forth.

Next, means is provided to assemble a replica of the card being loaded in a memory array, which includes an element identifier, the card number, and the coded potentially hittable numbers and their spatial locations. One way of accomplishing this is for Routine C10 to activate Routine C25, the Instructions to Assemble a Card Replica. Routine C25 then activates Routine C26, the Instructions to Assign a Memory Address to the Card, which assigns an address such as C27. Routine C25 then activates Routine C28, the Instructions to Assign an Element Identifier for the Card, such as C50, at memory C29. Each element is shown as having a type identifier for illustrative purposes, for distinguishing between card, hit pattern, and program elements. In the commercial embodiment, these identifiers may, or may not, be explicitly represented in the data. Next, Routine C25 activates Routine C30, the Instructions to Store the Card Number. Accordingly, Routine C30 retrives the current card number (in this case card number 01) from memory location C18, and stores it in the element C50 at memory location C31.

The next group of routines handle the number inputs in a manner so that when the player enters the numbers as they appear on the actual card (FIG. 1A) they will appear in the identical location on the display grid (FIG. 1B). As a result, a rapid and accurate verification of the entry can be made.

In order to facilitate such entry, and to minimize the number of keys which must be pressed in the loading of the cards, so as to make the device more easy to handle by players who are not computer adept, a particular loading sequence is followed, and the device is preprogrammed to follow such sequence. The preferred sequence is for the player to begin loading from the top to the bottom of the "B" column, and then on to the "T" column, and so forth. Because such sequence is logical, as it follows the word, Bingo, and because the upper left hand corner is a logical beginning location, it is easy for the player to follow.

Moreover, again to minimize the number of keys to be pressed, and thus to further make the device attractive to persons who are no computer adept means is provided to pass an entered number on to processing only when two digits have been entered. Since the numbers 1 to 9 have only one digit, the player quickly learns to input the digit zero before the numbers 1 to 9. Such approach eliminates the need to press an enter key each time a number is to be input. The player soon becomes accustomed to such procedure, as the numbers 1 to 9 are always displayed by the machine, preceeded by the digit zero. The device provides such 2 digit entry requirement, such as by the 2 digit acceptor instructions, C35, which is the first routine activated whenever a number is entered, by the number keys K1–K10. Of course, such 2 digit acceptor routine would require that the two digits be pressed in sequence, rather than simulataneously, before the routine would accept the number.

When the device is in the Load Mode, and two digits have been input, such as the number 14, by pressing keys K1 and K4 in sequence, and accepted by the two digit acceptor instructions C35, then Routing Routine C36 activates Routine C32, the Instructions to Store the Input Number, which store the input number, as at location C34 in Storage Array C33, from which it is retrieved by various other routines during processing.

As the first step in such processing, means is provided to validate the input number as one which, according to the rules of bingo, is valid for the column currently being entered in accordance with the previously described sequence of entering from the left hand column to the right. Such procedure further decreases the possibility of input error, particularly the error of reversing digits due to fast input.

An aspect of this procedure is that while no bingo card handed out in the session will have the identical combination of numbers, all cards will have the common feature that the numbers appearing thereon will appear in columns related to the range of numbers in which each number falls. According to the convention of Bingo, this arrangement is such that: in the first, or "B" column, the numbers appearing will always be between 1–15; in the second, or "T" column, between 16–30; in the third, the "N" column, from 31–45; in the fourth, or "G", column from 46–60; and in the "0" column from 61 to 75.

One way of carrying out the foregoing is for the Routines C35 and C32 to activate Routine C37, the Validating Instructions, which being programmed according to the aforesaid sequence of loading, keeps track of how many numbers have been input and, thus in which column the current input number would be located. It can then compare such number to the numbers assigned to the column by convention and determine whether such number is, in effect, a "valid" number for such column. By way of further illustration, for example, Routine C37 could actuate a Scanner Routine C42. Such routine would be set and reset to begin the loading process for each card by examining the table of numbers assigned by the rules of Bingo to column 1. Routine C37 would then activate the Scanner Routine C43 to commence with the first number valid for the column which has been designated by Routine C42, and then sequentially feed the valid numbers into a Comparator C43. Routine C37 would have retrieved the input number from array C33, in this case number 14 at location C34, and placed it in Comparator C41, where it is compared to each number fed into the comparator from the table of valid numbers C44 by Scanner Routine C43. If, at the completion of a scan by routine C43 no identity exists, the input number is an invalid number. Indexer routine C40 would remain at location C34 for replacement by another number, and Routine C37 would activate the means to inform the player that his entered number is invalid. For example, Routine C37 could activate Routine C47, the Instructions to Display, "Invalid Number", which, in turn, would retrieve the phrase "Invalid Number", from memory location C51 and activate the LCDs C9 to display the phrase, "Invalid Number" in the Window W. This informs the player to look at his card and reinput the number correctly.

As a further aid to accuracy of input, the input numbers remain displayed until all of the numbers have been input. This provides a convenient "place marker" for the player, as he need merely look at the display grid and know exactly which was the last number loaded, and thus, where his place is as to the next number to be input from the card C1. This not only increases the speed of loading, but it also increases accuracy of loading.

If during the comparison in Comparators C41, an identity does exist between the input number and the valid numbers for the column being input, Routine C37 then activates the next step by returning to Routine C25.

The next step is performed by the means to assign coordinates to the input number which correspond to the spatial position of the number on the original card C1, (FIG. 1A) so that when the number is displayed on the display grid B5 (FIG. 1B) it will have the same spatial position it did on the card, so that a ready visual comparison can be made, as a further check against input error.

As the next step, (FIG. 2A) C25 activates Routine C60, the Instructions To Assign Coordinates To The Validated Input Number. As the first Step, a column ordinate is assigned. Accordingly, Routine C60 activates Routine C61, the Instructions To Determine The Column Ordinate. Routine C61, causes the Column Incrementer Routine C63 to retrieve the Current Column Number from memory location C62 and increment it by one. The current column number at the start is zero, and thus is incremented to 1 when the first number is entered, and thus the current column for the first number is 1. Thereafter, the column incrementing is driven by the Row Reset Instructions, Routine C77 which outputs a signal each time the row is reset to one, which occurs each tima the row number output by the incrementer is greater than five. In the commercial embodiment, the column shift might be accomplished, instead, by loading the row number from its memory location into a register, incrementing it by 1, and comparing it to the maximum number, i.e. 5, and taking action on the results of the comparison.

The Incrementer Routine C63 then stores the number one in current memory location C62, and also in memory location C65 of element C50.

Routine C60 then activates Routine C75, the Instructions To Determine the Row Ordinate. Routine C75 activates the Row Incrementer Instructions C76 to retrieve the current row number (zero before the start on a new column) and increments it by one. (Since the first number entered will be in row one, memory location C74 is incremented from zero to one), by incrementer C76, which also stores the number one in the array C50 at location C70. Thus, the current number, being the first number, is automatically assigned the coordinates for the upper left hand square, i.e. column 1 and row 1.

Since the center square, by the convention of bingo is free of a "hittable number", means is provided to skip the center square when assigning coordinates to the entered numbers. This may be accomplished, for example, by a column sensor routine C67 which scans the output of the column incrementer C63, and when it is 3, Routine C67 activates the Row 3 Sensor Routine C68 which scans the output of the Row Incrementer C76. When the output is 3, Routine C68 then activates the Row 3 By-Pass Instructions, Routine C69, which causes the row to be incremented one more time, so that the row goes immediately to 4, and thus Column 3, Row 3 is not assigned to a hittable number.

Next, means are provided to assign the validated number to its coordinates. This may be accomplished, for example, by activating Routine C78, the Instructions To Assign the Validated Number To Its Coordinates In Card Memory which retrieves the number at which Indexer C40 is pointing, and transfers it to memory in the location adjacent the column and row coordinates. (In the example, number 14 is transferred from location C34 to location C79 in element C50).

Means is then provided to display the input number in the square corresponding to the square occupied by the number in the original card C1. Since the coordinates have already been assigned, Routine C110, the Instructions To Display The Input Number activates the Coordinate Allocator C111 to activate the display instructions for the square having the coordinates just stored in memory (in the example, column 1 and row 1, stored at memory locations C65 and C70 respectively, and thus square D1,1 Display Instructions, Routine C114 are activated) to retrieve the number associated with such coordinates from memory (in this case number 14 from location C79) and cause LCDs associated with the display Instructions, (in this case LCDs C115) to display the number (in this case number 14 in square D1, 1 as shown).

When the next number, number 8, is input by pressing the 0 key K10 and the 8 key K8, it is stored in array C33 at location C82, assigned coordinates 1;2, which are then stored at locations C83 and C84 in element C50, with the number 08 then being stored adjacent thereto in location C85. The number 08 is then retrieved by the Square D1; 2 Display Instructions C117 to activate LCDs C118 to display the number 08 at square D1, 2, as shown.

The remaining numbers of the column are then entered in like manner. The number 22, as can be seen from FIG. 1A begins the second, or "T" column. The number is input by striking the "2" key K2 twice, and is stored initially in location C86. Since six numbers would have been input when the number 22 is pressed, the Row Counter Reset C77 would have received six signals from Routine C60, and would allow the Column Incrementer C63 to increment by one, to produce the output "2", and the Row Incrementer would be reset to 1, and thus the number 22 would be assigned the coordinates 2;1 which are then stored at locations C87 and C88 respectively. The number 22 would then be stored adjacent thereto in location C89. The Coordinate Allocator C111 would activate Routine C119, the Square D2; 1 Display Instructions to cause LCDs C124 to display the number 22 in square D2; 1 of the Display Grid, as shown.

Prior to entry of the displayed numbers into permanent memory, means is provided for erasing an erroneously input number. Such erasure will probably occur immediately after the erroneous number is displayed. However, such erroneous number can also be erased at any time prior to entry. In the embodiment shown, the initiation of the erasing is commenced by pressing the Error Key K22 which, by way of the Routing Routine C90, causes the actuation of a Timer Routine C93 and Erase Instructions Routine C95. Routine C95 is instructed to erase the number and coordinates at which the Indexer C96 is pointing. This would be at the number currently being displayed. Assume, for example, that the number 19, as shown at memory location C102 in FIG. 2C, had erroneously been entered for square 2;2, at memory locations C101 and C102. The pressing of the Error Key K22 would cause squares C101 and C102 to be erased to clear square D2;2 as shown in FIG. 2B. The correct number 17 would then be entered and displayed as shown in FIG. 2D.

If the error is discovered after several numbers have been displayed, then means is provided to erase the displayed numbers back to the erroneous number. This could be accomplished, for example, by the timer Routine C93 giving off a signal after the error key K22 has been depressed a predetermined time, such as 1 second, and a signal each second thereafter, at 1 second intervals, provided the key is still held. The Index Forward And Reverse Instructions C94, upon the receipt of each signal, would activate the Routine C104 the Instructions To Index Back, to cause the Indexer Routine C96 to move back to erase one number and its coordinates for each time a signal is output by Timer Routine C93, to thereby progressively erase the displayed numbers back to the erroneous number.

After all the numbers from the card C1 (FIG. 1A) have been input, and compared for accuracy with the display grid of the device (FIG. 1B), the numbers can be entered. In the device of FIG. 2B, this is initiated by pressing the Enter Key K21. If the device is in the Load Mode when this key is pressed, the Routing Routine C120 activates the Enter Instructions C126 provided that the Routing Routine C120 has received a signal from the Display Number Counter C121 that 24 numbers have been displayed. The requirement of such signal from Counter C121 prevents a premature entry of the card into memory before all the hittable numbers on the card have been entered. The Display Number Counter C121, in turn, is incremented by 1 each time the Instructions To Display The Input Number is actuated, and decreased by 1 each time Routine C123, the Instructions To Subtract One From The Number Count is activated by the initial activation of the Erase Instructions C95 and each output of the Timer Routine C93, so that the Display Number Count is of the numbers displayed and retained.

On pressing the Enter Key, means is provided to permanently store the card element (in the example, element C50). Pressing the Enter Key C121 activates the Enter Instructions C126 to activate the Card Storage Instructions C127 which retrieve the card from Storage Location C27 and store it in permanent storage location C38.

Next, means is provided to clear the display grid. This could be accomplished, for example, by Routine C126 activating Routine C116, the Clear Instructions, which activate Routine C122, the Instructions for Rapid Reverse, which cause routine C116 which activates C94, the Index Forward and Reverse Instructions, which activates Indexer C96. Routine C116 also activates Erase Instructions C95, to erase the card from storage location C27, and thus clears the screen by turning off all the LCDs, shown generally at C130, to clear the display grid B5 as shown.

In order to prevent the commencement of loading of a card when memory is full, means is provided to so indicate to the player. For example, the output of Card Number Counter C131, which is incremented each time a card number is incremented in memory C18, is fed into a Comparator C135 into which is also fed the predetermined card capacity C136. When an equality exists, the Comparator C135 outputs a signal to Routine C137, the Instructions To Display Memory Full. Routine C137 retrieves the phrase, "MEMORY FULL" from memory location C138 and causes LCDs C139 to display the phrase, "MEMORY FULL" in display window W. When Comparator C135 detects an equality, it also activates Routine C140, the Instructions To Deactivate The Card Load Instructions, which prevent the input of any more cards.

It is to be understood that in the commercial embodiment, various modifications might be made. For example, the 2 digit acceptor instructions could be a standard routine in ROM that is part of the keyboard input handling code that requires that two digits be entered from the number keyboard for any number to be accepted for processing.

The indexer could be a register or storage location that contains a value denoting the current position within an array. This is referenced by one or more routines for purposes of controlling processing.

The columnar Scanner Routine could be reduced to a simple value in a register or storage location in memory that informs the applicable routine which column it is working with.

The commercial embodiment for validation could check the limits of the column. For example, for the B column, the expression would be: if $16>N>0$ then the number is valid.

In the commercial embodiment, the row and column coordinates, instead of being data values in the arrays, could be established by subscript values located elsewhere in memory that contain the current coordinate values for purposes of memory conservation, as is well known in the art.

Similarly, in the commercial embodiment, there might be one set of display software instructions instead of one for each grid location. Such one set of instructions might provide coordinate information and the value of the number to be displayed to a standard Liquid Crystal Display Routine, which may be in ROM.

Program Mode

Bingo has a large number of variations. Not only are different versions played in different parts of the country, but even within a particular locale, different games are played on different days, to provide variety for the players. As a result, a preprogramming of all the possible game patterns at the factory would require the use of a great deal of microprocessor memory. Even more important, such preprogramming would require the player to memorize or work with complicated charts or codes, thereby making factory programming of all possible versions undesirable. Thus, it is more practical for all but a few basic games to be programmed by the player. In fact, one of the advantages of the present invention is that even a person who is not computer adept can easily and acurately program a game, despite the natural resistance of the ordinary Bingo player to engaging in a process normally as abstruse as programming.

In carrying out programming on the device of the preferred embodiment, the player merely presses the program key, and then inputs each pattern simply by pressing the grid squares which correspond to the desired pattern. The squares are lit, or filled as they are pressed, so that the player has an immediate and clear visual representation that he can simply and rapidly visually check for accuracy. By the present invention, the device can program games even where Bingo is achieved by more than one pattern, or a combination of patterns. Yet the programming may be performed with speed and accuracy even by a computer novice.

Figure 3:
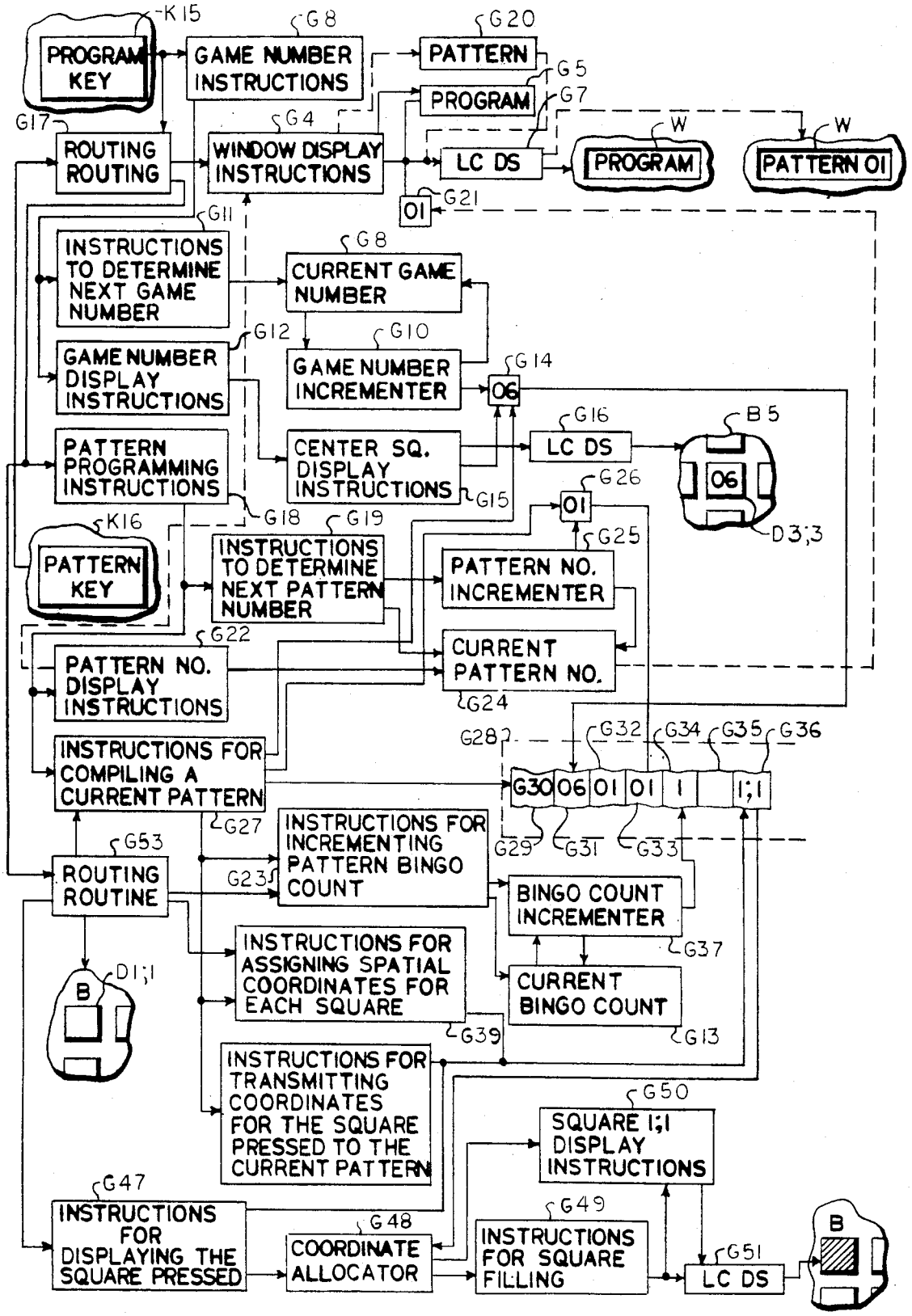
FIG. 3 is a partially fragmentary and partially schematic view of a portion of the Program Mode, illustrating the display of the directions, "Program", the display of the number of the game being programmed, the display of the pattern number of the pattern being programmed, and the illustration of the input and display of the first "square" of the pattern being programmed.

In order to commence the programming, means is provided for a player to place the device in a Program Mode to program any game to be played. In the embodiment of FIG. 3, the device is placed in the program mode by a program Key, K15.

Means is provided to indicate to the player that he is in the program mode when the program key is pressed. For example, the pressing of the Program Key K15 activates the Window Display Instructions G4 to retrieve the word, "Program" from its memory location G5 and activate the LCDs G7 to display the word, "Program" in the window W, so that the player knows that the device is in the program mode.

In one way of accomplishing this, the pressing of the program Key K15 also activates Routine G8, the Game Number instructions, which activate Routine G11, the Instructions To Determine The Next Game Number to retrieve the number of the last game programmed, from its memory location G9, enter it into the Game Number Incrementer G10, and instruct the Incrementer G10 to add 1 to the previous number, store the result in memory location G14 and in the Current Game Number memory location G9. Routine G8 then activates the Game Number Display Instructions G12 to cause the Center Square Display Instructions G15 to cause the LCDs G16 to display the number of the game from G14 in the center square 3, 3 of the display grid B5.

In the example, it is assumed that 5 games have already been programmed (either by the player, by the factory, or by a combination thereof). Accordingly, the number 05 was the last number stored in memory location G9, and becomes 06 after the incrementation. The number 06 then becomes the new number which is stored at memory location G14 and displayed at the center square D3, 3 of the display grid B5 to inform the player that he is programming the 6th game variation.

It is common for a game variation to have more than one way of winning. Accordingly, the present device provides for separate programming of each winning pattern, as a simple and accurate way of programming a game. As a first step in programming a game, means are provided for automatically assigning a number to each pattern (Beginning with the number 01), and for displaying this number adjacent the word, "Pattern" in the window display.

The player actuates this number assignment for a pattern simply by pressing the Pattern Key, K16. This, in effect, informs the machine that the player is ready to program a new pattern, and begins the process by activating Routine G18, the Pattern Programming Instructions, which are activated by the Routing Routine G17 only when both the Program Key K15 and the Pattern Key K16 have been pressed. Routine G18 first assigns a number to the pattern by Routine G19, the Instructions To Determine The Next Pattern Number, retrieving the last pattern number from its memory location G24 (this is zero when the first pattern of a game is being programmed), incrementing it by one in the Pattern Number Incrementer G25, and storing the result in memory location G26 and in the Current Pattern Number Memory location G24. Routine G18 then activates the Pattern number Display Instructions G22 to cause window display instructions G4 to retrieve the word, "Pattern" from its memory location G26, transfer it to memory location G21, and cause the window display instructions G4 to activate the LCDs G7 to display the phrase, "Pattern 01" in the window W so that the layer knows that he is programming pattern number 01 of game number 06 (the game number being displayed in the center square, as mentioned).

Assume that the player decides to program a game with four patterns, any one of which would constitute a bingo. As an example, assume that such a game is "One-Fourth Of A Picture Frame". In this game a bingo would occur if the player has "hits" on all the squares of column 1 (FIG. 3B), or all the squares of row 1 (FIG. 3C); or all the squares in column 5 (FIG. 3D) or all the squares in row 5 (FIG. 3E). Such a game is an example of an unusual game that could be called by a Bingo M.C. in order to liven up the play.

In some bingo locales, printed explanations of the games to be played that night, are provided before play begins. In other locales, the M.C. explains the game, either orally, or by referring to a chart. Upon receiving such instructions, the player need only rapidly punch the patterns into his game device. As far as the machine is concerned, it is irrevelant which pattern is chosen first.

Means is provided to establish an element for the pattern in memory. As an example of establishing an element, assume that the player begins the programming by choosing as the first pattern the left hand quarter of a picture frame (i.e. all of column 1, as shown in FIG. 3B). When the pattern Key K16 is pressed, not only does Routine G18 activate other routines to automatically display the next pattern number, but it also activates Routine G27, the Instructions For Compiling A Current Pattern, which assembles a game pattern in an Element in Storage Array G28. As the first step in such assembly, Routine G27 gives the game pattern an element identifier, such as G30 (shown at G29). Routine G27 also retrieves the game number from location G14 (Number 06 in the example) and stores it in the array at G31.

Means is also provided to store the current pattern number in memory, and to determine the total number of patterns which constitute the game. In carrying this out, for example, Routine G27 retrieves the previously determined current pattern number from location G26 (no. 01 in the example) and stores it in the element as the current pattern number at G33, and also as the total pattern number at G32. During programming, the pattern number of the current pattern is always the same as the total program number, as the patterns are added sequentially. The total number is used later in the processing as a check to be sure that all of the patterns of the game have been searched in looking for a bingo or alert situation as described later herein.

Means is provided to establish a bingo count for the pattern—i.e. the number of "hits" necessary for a bingo to occur. This number is the number of squares that make up a pattern. For example, when the player presses the first square of the pattern (in the present example, the upper left hand corner display square D1, 1), the impulse passes through a Routing Routine G53 to activate Routine G23, the Instructions For Incrementing A Pattern's Bingo Count. Routine G23 retrieves the current Bingo Count from memory location G13 (zero when a pattern is beginning) inputs it into the Bingo Count Incrementer G37 where 1 is added to it, and the new count is stored in the Current Bingo Count memory location G13, and in the pattern array at G34. The Bingo Count for a pattern is used later in the processing to determine when a Bingo or an Alert for such pattern occurs during play, as discussed later herein.

In order to provide for input of the pattern squares, means is provided to input coded indications of the spatial location on a 5×5 grid of each square of the pattern being programmed. In the preferred embodiment, this means is provided by the squares providing such coordinate input when pressed by the player. In a bingo session, the player either knows, or the M.C. provides a diagram or description of the various combinations that make up the game to be played. For example in the one-quarter picture frame game, the M.C. would state that bingo occurs when any quarter, or side, of the picture frame is complete. The player, in programming, merely presses the squares on the display grid B5, which correspond to one of the sides of a picture frame, for the first pattern, and then proceeds with the remaining sides for the remaining patterns. Each square, when pressed, actuates routines which provide a coded representation of the column and row coordinate locations on the 5×5 grid which the particular square occupies.

The squares, in essence, act as switches. An example of a mounting of an exemplary square is shown in FIG. 1C, for square D1,1. The square D1,1 could have a casing B40 of translucent and transparent material in which liquid crystal display units (LCDs) G51 are mounted. Units G51 could have lead wires such as B46–B49 for connecting the LCDs to routines for displaying numbers, when in the Load and Play modes, and for being filled with light for the Program mode.

The square D1,1 casing B40 is shown carried by a spring means B44 mounted on the floor B45 of the device B1, and which projects upwardly through an opening B50 in the top surface B4 of the device. The square D1,1 casing B40 has a contact B52 on its lower surface, B53, and connected to lead wire B54.

Another contact, B55 is mounted on the floor B45, and is connected to lead wire B56. When the square D1,1 is pressed, contacts B52 and B55 close, actuating Routing Routine G53 to initiate the routines for compiling a game pattern, and for filling the squares, by filling the square with light. The routines are such that the square remains filled with light after the pressure has been removed, and the square returns to its original position. Such squares remain lit until turned off by other routines.

To initiate the foregoing, the pressing of square D1,1 activates Routing Routine G53, which activates Routine G39, the Instructions For Assigning Spatial Location Coordinates For Each Square, which assigns square D1,1 the column coordinate 1 and the row coordinate 1. Routine G39 also activates Routine G46, the Instructions For Transmitting The Coordinates For the Square Pressed To The Current Pattern, which routine stores the coordinates 1,1 at memory location G36 in the pattern element. Location G35 is left blank, as this will be the playing hit count (which is incremented during play each time a hit occurs, as described later herein).

As mentioned, means is provided to fill the square pressed, with light, to provide a visual indication that the square pressed is part of the pattern being programmed. The pressing of square D1,1 activates Routing Routine G47, the Instructions For Display Of The Square Pressed, which retrieves the coordinates 1,1 from location G36 and feeds them to the Coordinate Allocator Routine G48, which directs them to the Square 1,1 Display Instructions G50, and also activates Routine G49, the Instructions For Square Filling, which causes LCDs G51 to fill the square D1,1 so that the player has an immediate visual indication that such square is part of the pattern being programmed.

Figure 3A:
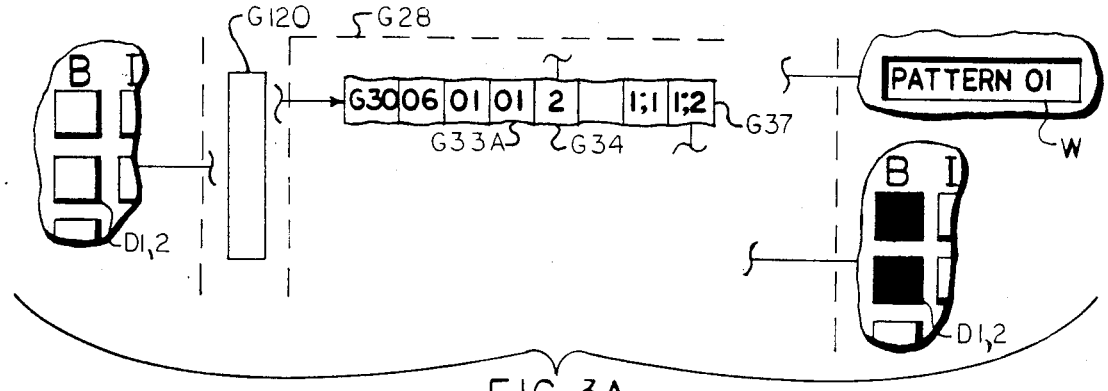
FIG. 3A is a partially fragmentary and partially schematic view of a portion of the Program Mode, illustrating the input and display of the second square of the pattern begun in FIG. 3.
Figure 3B:
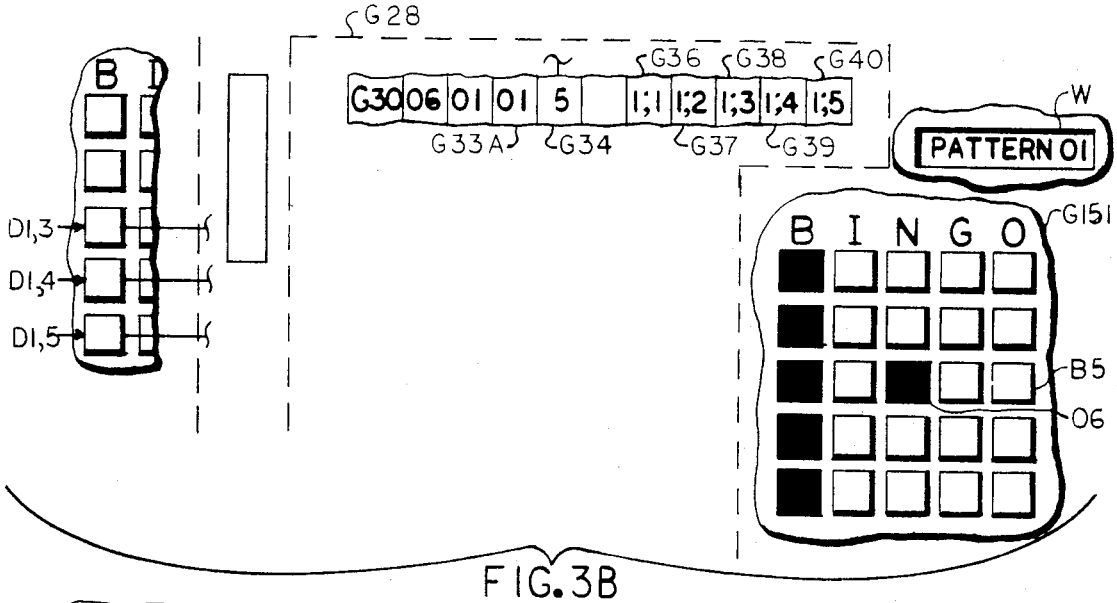
FIG. 3B is a partially fragmentary and partially schematic view of a portion of the program mode illustrating the completion of the pattern of FIGS. 3 and 3A.

Then, as shown in FIG. 3A, the next square, in the example, square D1,2, is pressed, activating the previously described routines to store the square coordinates 1,2 at location G37 in the compiled pattern G30 and to increment the pattern Bingo Count to 2 at G34.

The player then continues to press the squares in the "1" column until all the column "1" squares are stored in pattern G30 at locations G36–G40, (FIG. 3A) and displayed on the grid as shwon in FIG. 3B, thus completing pattern no. 1. Note that the pattern Bingo Count has been incremented to 5 at location G34, as 5 hits in pattern no. 1 constitute a Bingo.

Figure 3C:
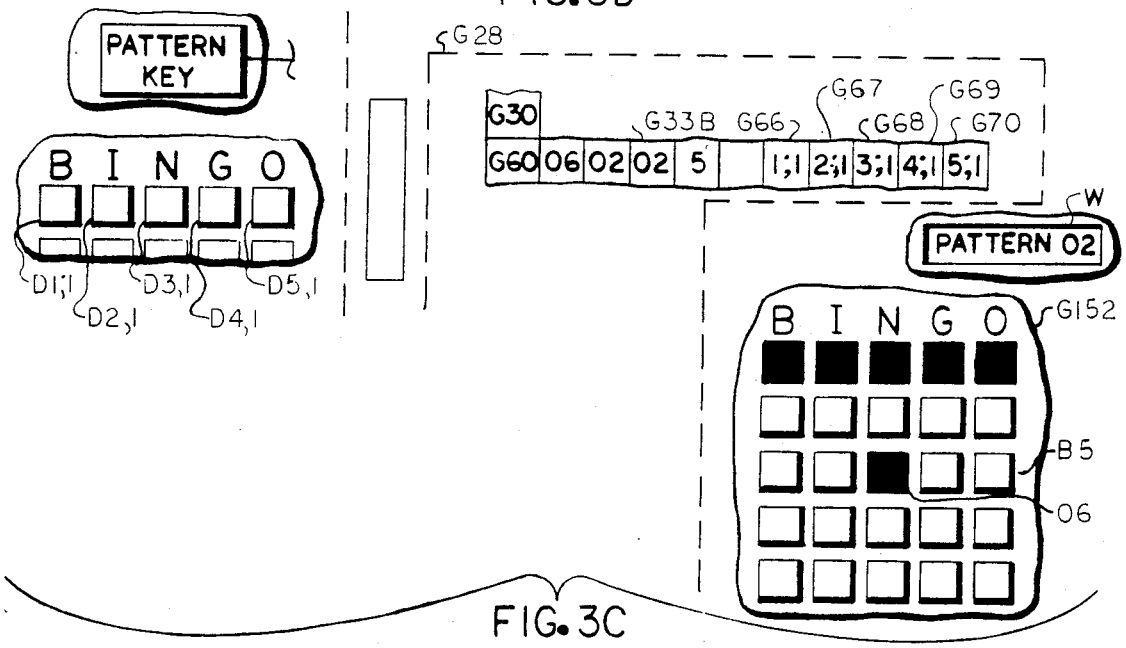

In order to program the next pattern, such as the "upper" ¼ of a picture frame, the player then presses the pattern key K16 which activates the Pattern Number Incrementer G25 (FIG. 3) which provides the next pattern number (in this case no. 2) displayed at window W (FIG. 3C), and assigns pattern number 2 a new element identifier, such as G60, and stores the number 02 in memory, as at G33B. The pressing of the display grid squares D1,1 to D5,1 causes such sequence to be stored as part of pattern no. 2 of game 6 at locations G66–G70 respectively, and to display the pattern as shown in FIG. 3C.

Figure 3D:
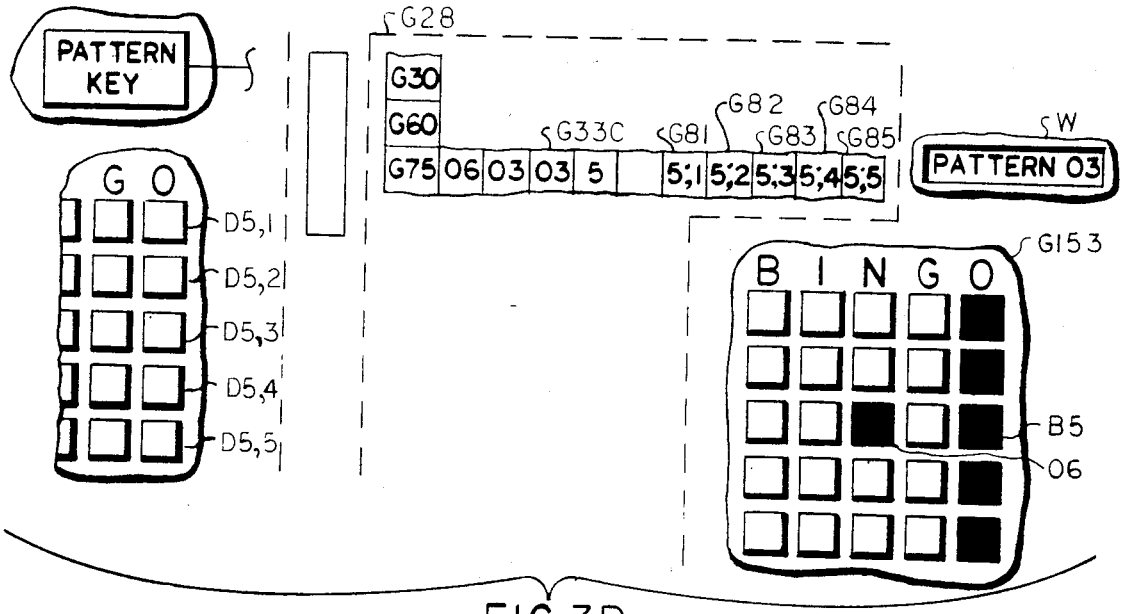
Figure 3E:
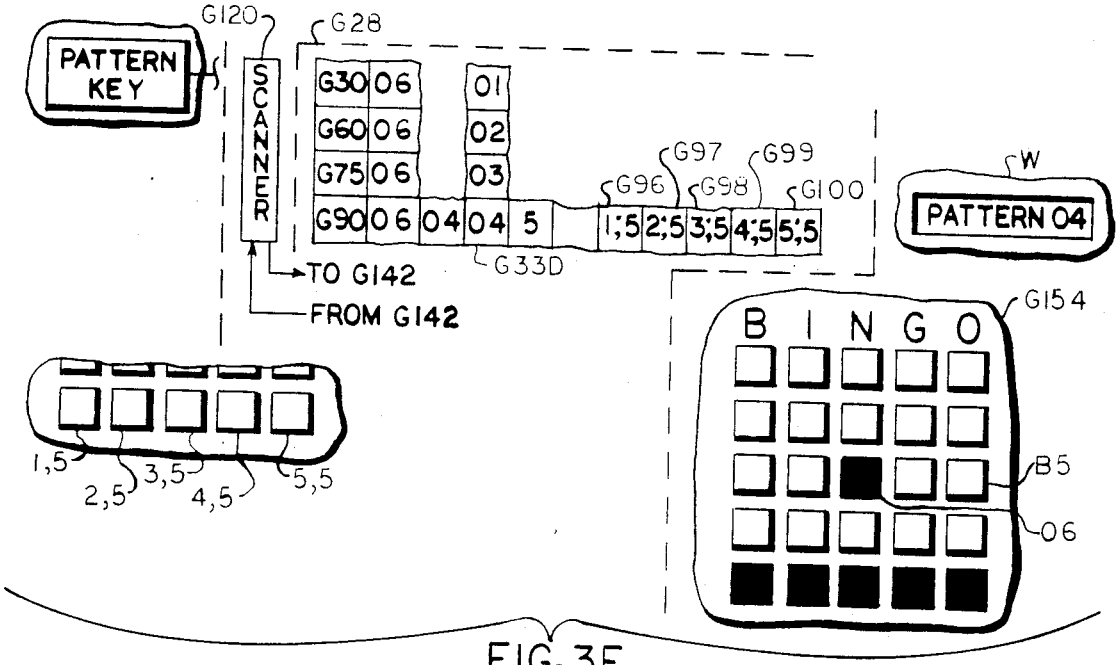

Similarly, pattern no. 3 is programmed, as shown in FIG. 3D. The element is assigned identifier G75, the pattern no. 03 is stored at G33C, and the coordinates of squares D5,1–D5,5 are stored at locations G81–G85, and the pattern is displayed, as shown in FIG. 3D.

Pattern No. 4 is programmed as shown in FIG. 3E, with array identifier G90 being assigned to it. The pattern number 04 is stored at G33D, and the coordinates of squares D1,5 to D5,5 are stored at locations G96–G100, with the pattern being displayed on the display grid B5, as shown in FIG. 3E.

While it is to be understood that the preprogrammed games, such as regular bingo, will be programmed at the factory in a Read Only Memory by conventional techniques, rather than by use of the dual function squares, the preprogrammed games will be stored in memory so that each game and its associated pattern can be retrieved during Play and acted on during Play in the same manner as a player-programmed game.

Figure 3F:
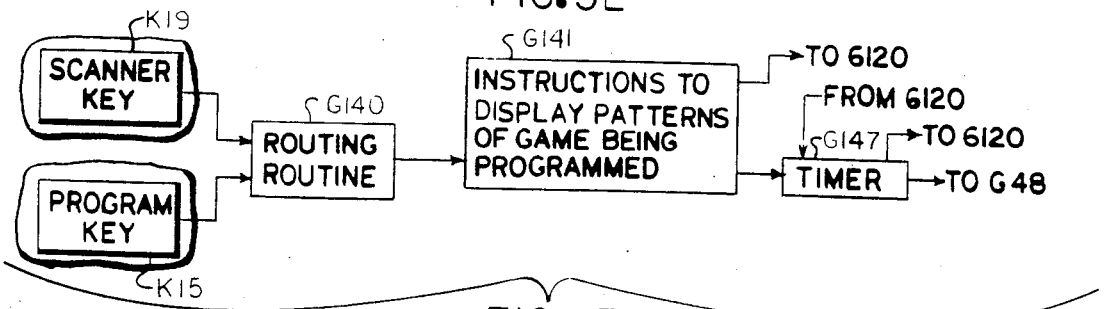
FIG. 3F is a partially schematic and partially fragmentary view of a portion of the Program Mode, illustrating the scanning means to reproduce the patterns of the game to the extent that they have been programmed.

During the programming of a game, the player may want to review the result to verify that the game is being correctly programmed. Accordingly, means is provided to review the patterns programmed. If the device is in the Program Mode when the Scan Key K19 is pressed (FIG. 3F), the Routing Routine G140 activates Routine G141, the Instructions To Display The Patterns Of The Game Being Programmed. The patterns are retrieved from Storage Area G28 by Scanner Routine G120, to enable it to go to the next pattern, if any, until all the patterns are displayed. For the display, the pattern at which the Scanner Routine G120 is currently pointing is routed by the timer routine to the Coordinate Allocator G48 (FIG. 3) which fills the squares of the pattern at which the Scanner is located in its indexing, as controlled by the timer routine G147.

Figure 3G:
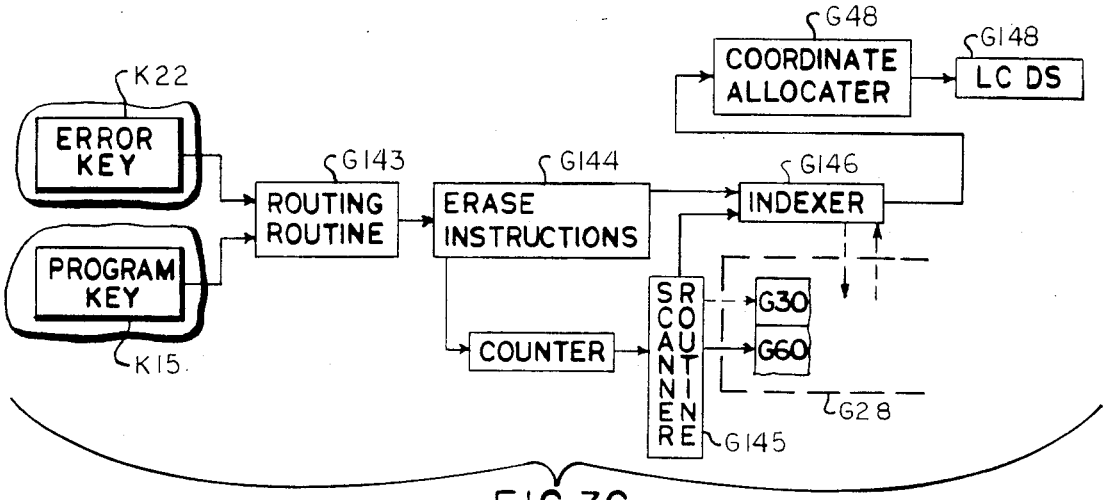
FIG. 3G is a partially fragmentary and partially schematic view of a portion of the Program Mode illustrating the error correction means for an erroneously entered square of a pattern.

In the event there is an error in programming, means is provided to erase a pattern. The eraasure procedure is shown generally at FIG. 3G. If in the Program Mode when the Error Key K22 is pressed (FIG. 3G), the Routing Routine G143 activates Routine G144, the Erase Instructions, to activate Scanner Routine G145 to cause the coordinates of the pattern being programmed (or just completed) to be erased by the back indexing of indexer G146, which, through the coordinate allocator G48 deactivates the LCDs G148 for the pattern. A Counter Routine back indexes the Scanner Routine G145 each time the Error Key is pressed, so that only the current pattern, or each previous pattern, can be erased, by pressing the Error Key for each pattern to be erased. The Indexer Routine G146 always returns to the last square entered for any pattern before back indexing for the erasure, so that the whole pattern is erased.

Upon completion of the programming of a game, means is provided to store the patterns in a permanent storage. The player presses the Enter Key K22 (FIG. 3H) to activate Routine G110, the Instructions To Store Patterns In Permanent Storage, which retrieves the patterns from location G28, and stores them in permanent storage Area G165.

Figure 3H:
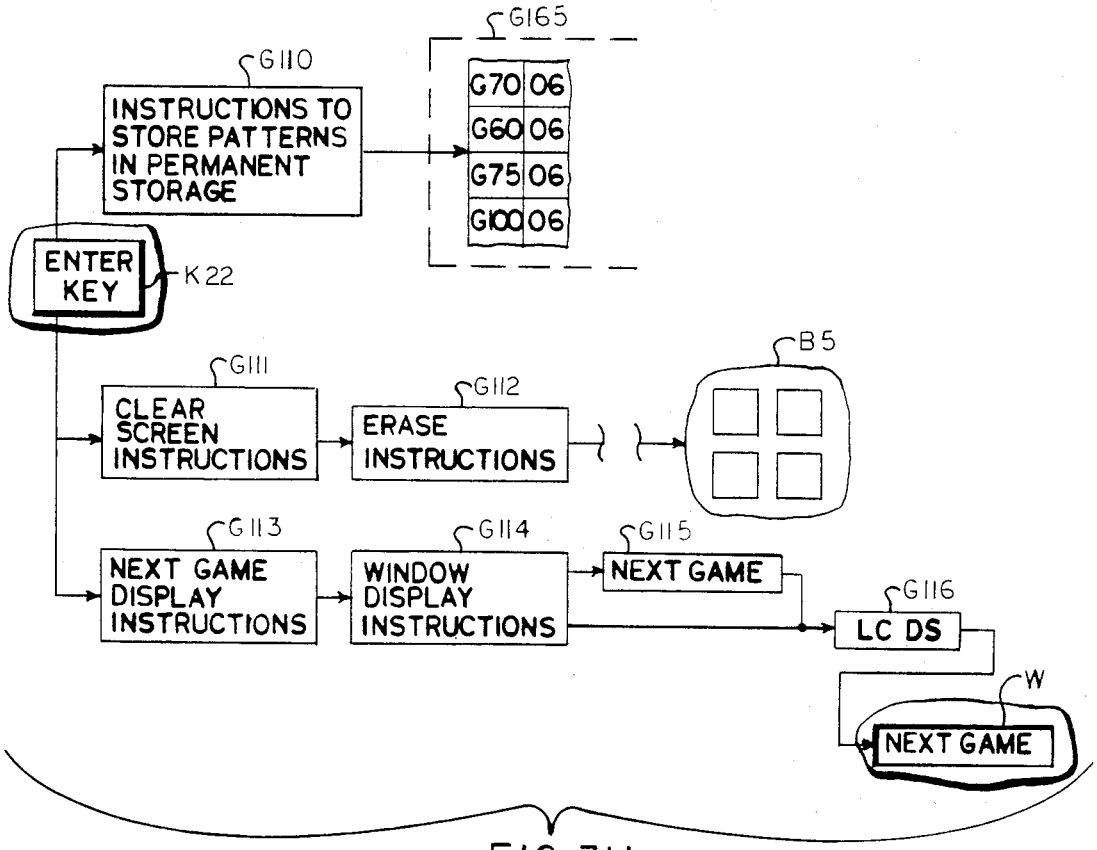
FIG. 3H is a partially fragmentary and partially schematic view of a portion of the Program Mode illustrating the entry of the patterns of a game into memory, the clearing of the screen, and the display of the direction to select the "Next Game".

Means is provided to clear the screen. In this regard, the pressing of the Enter Key K22 also actuates Routine G111, the Clear Screen Instructions, which simply turns off all the LCDs, clearing the screen B5, as shown at FIG. 3H.

Means is also provided to direct the player to select the next game to be programmed. To accomplish this, Enter Key K22 actuates Routine G113, the Next Game Display Instructions, to activate Routine G114, the Window Display Instructions, to retrieve the phrase, "NEXT GAME" from memory location G115, and cause LCDs 116 to display the phrase, "NEXT GAME" in window W.

If the player does not want to program another game, but wants, instead to proceed to play, he merely presses the PLAY key, and places the device in the Play mode.

While not shown, it is understood by one of ordinary skill in the computer art that the Routing Instructions for the Play, Program, and Load Mode will deactivate a previous mode when any of such keys are pressed as the next mode.

Play Mode

Once the card replicas have been loaded, and the game to be played is programmed by the player (or is one of the factory preprogrammed games) the player is ready to play. Accordingly, he presses the Play Key K17, which activates the Play Instructions P1 to initiate a plurality of operations which are part of the play mode.

First, in the preferred embodiment, means is provided to indicate to the player that his next step is to select the game he wants to play. For example, this could be accomplished by Routine P1 activating the Window Display Instructions P4 to retrieve the phrase, "SELECT GAME", from its memory locations P6 to cause LCDs P7 to display the phrase, "SELECT GAME", in the window W to inform the player that his next step is to select a game.

Figure 4:
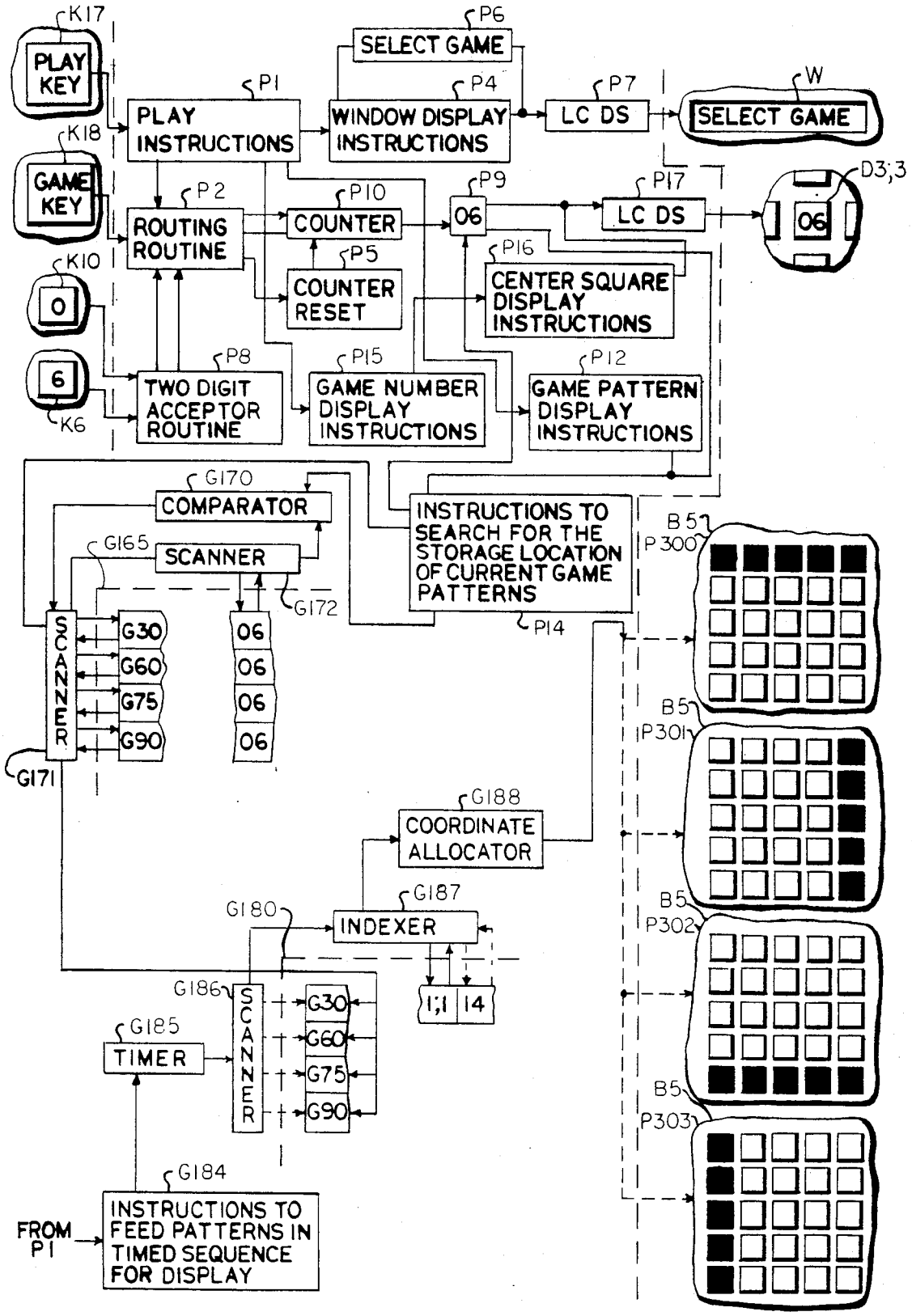
FIG. 4 is a partially fragmentary and partially schematic view of a portion of the Play Mode illustrating the display of the directions, "Select Game", the display of the game number selected, and the display of the patterns of the game selected.

Next, means is provided for the player to select a preprogrammed game (which was programmed either at the factory or by the player). This could be accomplished, for example, by the player pressing a code, such as a game number, which corresponds to the game to be played. Assume, for example, that the game to be played is "One-Quarter-Picture-Frame", a game which was programmed by the player, as previously described, and which was given the code designation 06. As shown in FIG. 4, the player can select game number 06 by pressing the Game Key K18, and the number of the game. Since the game number chosen has only one digit, and the device responds to two digit entries, he first presses the digit 0 and then the digit 6, so that the number 06 is passed, by the 2 Digit Acceptor Routine P8, and passed by the Routing Routine P2 through the counter P10 to the Current Game Number Storage Location P9. Such passage occurs because the Routing Routine P2 has received inputs from the Play Key, K17, which indicates the play mode, and the Game Key K18, (which indicates that the game to be played is to be selected) so that, in effect, it "recognizes" that the next number received is the game code number, and passes it to the storage location P9.

Next, means is provided to display the code number of the game selected. This could be accomplished, for example, by a first time switch in the form of a counter P10 which, upon counting the first number input, sends a signal to Routine P1, to activate the Game Number Display Instructions P15, which, in turn, cause the Center Square Display Instruction P16 to retrieve the number 06 from memory location P9, and cause the D3,3 LCDs P17 to display the number 06 in the center display square so that the player can verify that he has pressed the game number he wanted, and to clearly indicate that the device is now ready to play game number 06.

Means is also provided to display the patterns of the game selected, so that the player may verify that he has selected the desired game. Accordingly, the receipt of the signal from Counter P10 could also actuate Routine P1 to activate Routine 12, the Game Pattern Display Instructions, to display the patterns one at a time on the display grid B5, such as shown at P300 to P303 in FIG. 4, so that the player can verify that he has chosen the correct game. As an example of a means for carrying this out, Routine P12 actuates Routine P14, the Instructions To Search For The Storage Location Of The Current Game Patterns, which retrieves the current game number from memory location P9 and searches the Game Pattern locations to locate the storage area for the patterns of such game number. For example, Routine P14 activates Scanner Routines G171 and G172 to scan the game number fields of the pattern storage area G165, and sequentially feed such game numbers into Comparator G170 into which Routine P14 has fed the game number selected, in this case, number 06. When an identity occurs, comparator G170 sends a signal to Routine G171 to retrieve the pattern and place it in working storage area G180. Routine G184, the Instructions to Feed Patterns in Timed Sequence Display, is then activated by Routine P1 to actuate Timer Routine G185 to signal Routine G186 in timed intervals, such as one second, determined by the Timer Routine, to activate Indexer Routine G187 to feed the coordinates of the pattern into coordinate allocator G188 which activates the corresponding LCDs (not shown) to sequentially display the patterns for one second each, such as at P300–P303.

In the commercial embodiment, in order to save memory space, the foregoing might be accomplished by supplying the memory locations of the patterns to be displayed to Routine G141 (FIG. 3G) in order to reduce redundancy of routines.

In order to clear the screen of the game patterns, means is also provided whereby upon input of the first number called by the M.C., the display of the last game pattern is cleared. For example, when the first called number is entered, counter P10 would output a second signal to Routing Routine P2 which would signal Routine P1, to clear the game pattern display and to prepare for the processing of input called numbers.

Called Number Display

In accordance with the preferred embodiment, means is provided to display each called number below the letter associated with such number, in accordance with the rules of Bingo. For example, assume that the first number called by the M.C. is "B14". An aspect of the present invention is that the player need concentrate only on the number "14", and not on the letter "B" plus the number, because the machine will reproduce the number 14 automatically immediately below the letter B. Because the player need focus only on the number, the chances of error in entry, due to forgetting the number between the time of hearing it, and the time of entry, is greatly decreased. By contrast, in conventional play, the player must listen consciously for the letter, as it is by the letter, not the number, that he locates the column in which to search for the number. However, in concentrating on the letter, he often forgets the number, or never hears it accurately in the first place. Accordingly, means is provided in the present device for entering only the number, with the device automatically displaying the number below the letter with which it is conventionally associated.

For example, when the first letter and number combination, such as B14, is called by the M.C., the player merely presses (FIG. 4A) the "1" key K1, and the "4" key, K4, which are accepted by the 2-digit acceptor routine P8 as the number 14, which is passed by the routing routine P2 to the counter routine P10 to switch the routing routine P2 to a condition wherein it passes this and all subsequent number inputs in the play mode (Except when the Scan Key is pressed, as discussed hereinafter) to the called Number Processing Instructions, Routine P3, which receive the called number 14 from the routing routine P2 and store it at memory location P20. The Play Instructions P1 then activate Routine P24, the Called Number Display Instructions, which, in turn, activate a series of routines to display the number 14 at the top of a display column which is just below the letter that always "goes with" the number 14, by the conventions of Bingo. According to this convention, every fifteen numbers belong to one of the letters of the word, Bingo. The letter "B" always precedes the numbers 1–15 and is thus at the head of the first column when such numbers are called; "I" precedes 16–30 and is thus at the head of the second column, "N" precedes 31–45 and is at the head of the third column "G" precedes 46–60 and is at the head of the fourth column and "O" precedes 61–75 and is at the head of the fifth column. The aforesaid column and number relationship is stored in memory, as at table or matrix P28.

When the Called Number Display Instructions P24 are activated, they first activate Routine P25, the "Instructions For Locating The Display Column", which determines the range in which the newly received number falls, and thus, the "letter" to which it belongs. The first step is to activate the Column Scanner Routine P26 which, together with the Number Scanner Routine P27, scans the column number-range files in memory matrix or table P28 to successively feed the numbers from the range files into the Number Comparator P30, into which Routine P25 also feeds the current number from memory location P20. When a number identity is found, the Number Comparator P30 emits a signal to Routine P26 to place the number of the column (in this case column 1) into a memory location P31. Comparator P30 also emits a signal to activate Routine P34, The Instructions For Displaying The Number At The Top Of The Located Column. Routine P34 feeds the number of the column (in this case column 1) into the Column Allocator P33 which then activates the column 1 (and row 1) Display Instructions P35 to retrieve from memory location P36 the number output of Comparator P30 (in this case no. 14) and cause LCDs P37 to display the number in the D1, 1 square (which is just below the letter "B"). It is to be noted that the row will always be 1 since it is desired to show the called number always in the first row. Since a called number has no "row" it can be shown anywhere, but showing its in the first row places it just below the letter associated with the number to enhance the subliminal association of the letter and number.

As a result of the foregoing operations, although the number is entered without the need to concentrate on the letter, the number, as mentioned, appears immediately below the letter associated with it. In this manner, the player still has the emotional security of associating the number with the letter, and thus the process simulates an aspect of Bingo to which he has become accustomed, yet accuracy of input is increased because entry is made without consciously concentrating on the letter. Moreover, the subsequent appearance of the number below the letter actually provides a further check. Even though a player concentrates only on the number, he subliminally hears the letter. If for some reason the letter that he thought he heard, subconsciously does not appear above the number, he then has a cross-check as to the accuracy of his entry. He can then immediately ask for a repeat of the called letter and number by the M.C.

It is to be understood that the called number processing instructions could include a test to verify that the number input is not greater than 75, the maximum legal bingo number, and discard any number over 75.

If upon visual check of the number input, the player realizes that such number is incorrect, he merely presses the Error Key K22, and means is provided to erase the number. For example, the pressing of Error Key K22 could actuate Routing Routine P21 to activate Erase Instructions P22 to erase the called, and displayed, number from location P36, and from the display.

Hit Determination

Means is provided to commence the processing of the called number in accordance with the invention. For example, the process in the embodiment shown is commenced by the player pressing the Enter Key K21 after he has viewed the displayed number. Since the Enter Key K21 is pressed after the Play Key K17 and the Game Key K18 have been pressed, the Routing Routine P32 activates Routine P38, the Instructions for Entering the Displayed Called Numbers.

As a first step, means is provided to give an indication that the displayed number has been entered. It is preferred that this be an audible indication. Thus, in the embodiment of FIG. 4A, Routine P38 activates Routine P18, the instructions for giving an audible indication that the displayed number has been entered. Routine P18 then activates sound producer P19 to give off a sound, such as a "Beep".

Means is provided to store the entered number. For example, Routine P38 activates Routine P38, the Instructions for Temporarily Storing the Called Number, which then stores the number in location P43 (FIG. 4B) from which the number is subsequently processed.

As the first step in this processing, means is provided to determine whether the entered number is identical to a number of any of the loaded cards, and if so, whether such number identity is within a pattern of the game being played, so as to constitute a "hit" on such pattern.

Accordingly Routine P38 then activates Routine P40 (FIG. 4B) the Instructions For Determining What Pattern Hits Have Occurred. These instructions could, for example first actuate means to determine whether an identity exists between the called number and any number on the card without regard to the pattern. For example, Routine P40 could actuate Routine P41, the Instructions For Determining If A Number Identity Has Occurred. Routine P41 actuates Routine P42, the Instructions for Feeding the Called Number to the Number Comparator. Routine P42 retrieves the number, in this case, number 14, from the current number memory location P43, and enters it into the Number Comparator P44 where it is compared to the numbers on the currently examined card to determine whether any number matches exist.

In order to begin the comparison of the called numbers with the numbers on each card, Routine P40 then activates Routine P45, the Instructions for Locating the Current Card (i.e., the card to be presently examined). In doing this, Routine P45 retrieves the previous card number (which, at the start is zero) from memory location P46 and enters it into the Card Number Incrementer P47, which adds 1 to the number to provide the identification of the next card. Routine P45 then locates the identified next card which then becomes the curent card. In the example of FIG. 4B, the current card is card number 1, which had been stored in memory area C38 during the loading operation. The card is retrieved by a method similar to that described in connection with the search for the current game pattern by routine P14 and need not be shown or identical in detail. Routine P45 transmits the card (in this case card number 1) to the Scanning Register P48. Routine P45 then activates Routine P49, the Instructions for Feeding numbers from the Current Card into the Number Comparator. Routine P49 activates the Number Scanner Routine P51, which successively feeds the hittable numbers on card number 1 into the Number Comparator P44 where they are compared to the current number, in this case 14. When an identity exists between a called number and a number on a card, a "number identity" occurs. This number (14 in the example) is then stored in memory location P52 for use later on.

The "number identity" may not be in a location that is part of a pattern of the game selected. Therefore, means is provided to compare the coordinates where the number identity ooccurred with the selected game pattern to see if the number identity is in a square which is part of a pattern of the selected game, and if so, then a "pattern hit" has occurred, moving the player one step closer to a bingo in the pattern in which the hit has occurred. One way of accomplishing this is by implementing Routine P54, the Instructions for Determining if a Pattern Hit has occurred, which is actuated when a number hit occurs in Number Comparator P44. Routine P54 then carries out the steps to determine whether the "number identity" is also a "pattern hit". For example, first, Routine P55, the Instructions for Feeding the Coordinates of a Number Hit into the Coordinate Comparator, is activated. These instructions cause a Card Coordinate Scanner Routine P56 to retrieve the card coordinates of the hit number, in this case 1; 1, as this is the location of the number 14 on card No. 1, and feed them into the Coordinate Comparator P57. Routine P54 also activates Routine P58, the Instructions For Locating The Current Pattern. These instructions retrieve the previous pattern number from its memory location P59, increment it by 1 in Pattern Number Incrementer P60 to arrive at the next pattern number (i.e. the "current" pattern number stored at P50). In the example, the current pattern number would be 1 since the previous pattern number would be zero having been initialized to zero. Routine P58 then retrieves pattern No. 1 of Game No. 6 from its memory location, in this case from storage area G165 where it was stored during the programming process. The method of retrieval is similar to that described in connection with the search for the current game pattern by Routine P14, and need not be shown or described in detail. Routine P58 places the pattern (in this case Pattern G30) in Scanning Register P61. Routine P62 the Instructions for Feeding the Coordinates of the Current Pattern into the Coordinate Comparator, causes Coordinate Scanner Routine P63 to sequentially feed each coordinate pair into the Coordinate Comparator P57. When an equality is found, between the coordinates where a number identity has occurred and the coordinates of a square of a game pattern, a Pattern Hit is detected as having occurred, and the location of the hit stored at P64 for use later on.

In the commercial embodiment, processing time might be reduced by first determining from the game patterns the coordinates of the numbers to be compared, and then searching for a number identity only within those patterns.

Means are provided to then initiate a Hit Pattern Element if the hit is the first hit for the pattern, or to increment an existing Hit Pattern Element if the pattern already has one or more hits. This could be accomplished, for example, by a Routine P67, the Instructions to Determine if the Pattern Hit is to Initiate a New Hit Pattern Element Or To Be Added to an Existing Hit Pattern Element. Routine P67 could be actuated by an output signal from Coordinate Comparator P57. Routine P67, in turn, would then retrieve the Pattern Identifier, G30 in the example, from the Storage Location of the pattern which was just hit, in the example Pattern G30, and feed it into a Comparator P69 into which Routine P67 also causes the Pattern Identifiers of previously hit patterns to be sequentially fed to determine whether the currently hit pattern has an identifier which is the same as any previously hit pattern, and if so, which pattern. In carrying this out, for example, Routine P67 could actuate a Scanner Routine P85 which, along with Scanner Routine P86, would sequentially search each hit pattern in Hit Pattern Storage Array P71, described later herein to locate and feed into Comparator P69 sequentially the Pattern Identifier of each Hit Pattern. If the output of all the patterns scanned is zero, i.e. a Hit Pattern for the pattern just hit has not yet been established, then Routine P87, The Instructions To Establish A New Hit Pattern Element is activated to cause the formation of a new Hit Pattern Element.

In the commercial embodiment, the Scanner Routine might employ a subscript set to zero and incremented by one in order to examine the elements one at a time in the hit pattern array for an identity in the pattern identifier field. When an identity exists, the coordinates of the current hit, and the number hit, are appended to that element. When the search is exhausted without finding an identity, the new hit pattern element is established in the next available empty slot in the array, and the hit pattern identifier could be assigned by adding one to the previous hit pattern element.

The purpose of the Hit Pattern Array is to provide one means of maintaining a record of the progress of each pattern on each card towards a bingo. Each element of the array could contain, for example, such items as an identifier for the element, an identifier for the card element on which the hit occurred, the card number, an identifier for the pattern element, a code number for the game, the number of patterns in the game, the identifying number of the pattern involved, the bingo count for the pattern, the current hit count for the pattern, the coordinate location of the hit, and the numeral which was hit.

Figure 4C:
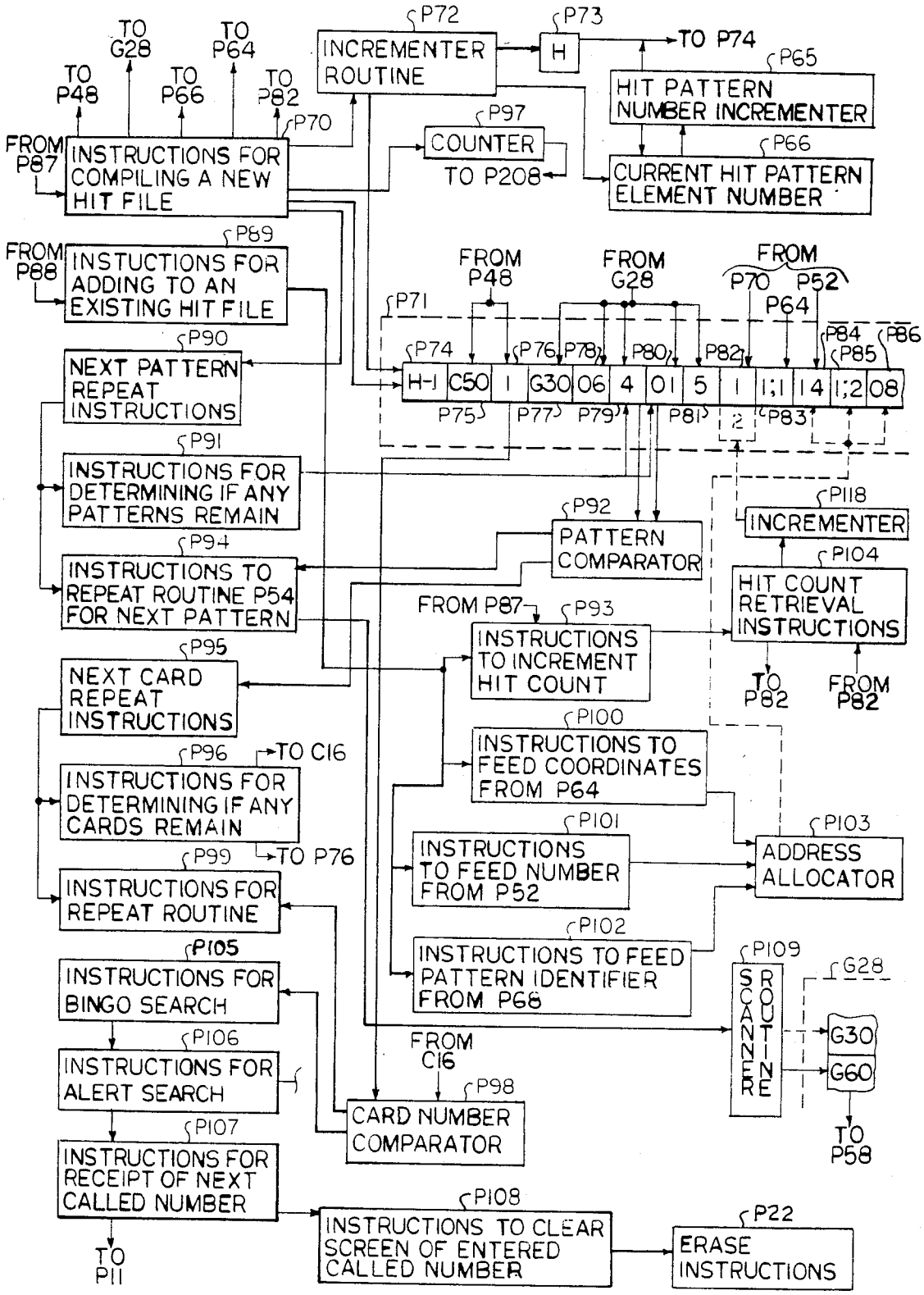
FIG. 4C is a schematic view of a portion of the Play Mode illustrating the formation of a hit file in memory, the making of additions to the file, and the steps for repeating the operations of FIGS. 4A–4C for the input number on the remaining patterns of the game for the current game card, and then for all the cards in memory, as well as illustrating the initiation of a bingo search and an alert search, and then the clearing of the entered number from the display when the searches are complete, and the device is ready to receive the next number.
Figure 4D:
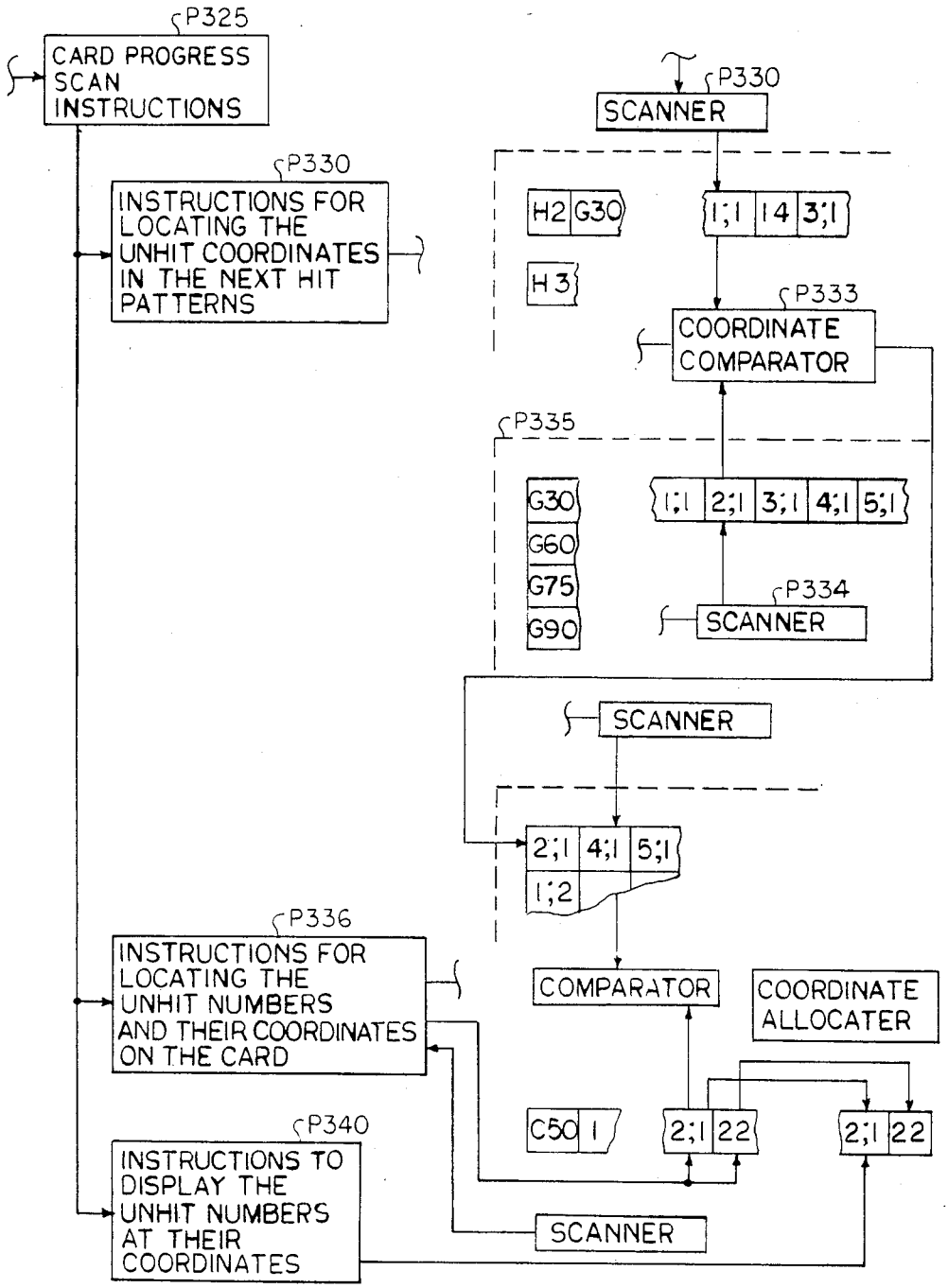
FIG. 4D is a partially fragmentary and partially schematic view illustrating the scn operation to display the unhit members of a particular card upon selection of the card by the player.

An illustrative example of the assembly of a Hit Pattern Element is shown in FIGS. 4B and 4C. Since the no. 14 was the first number called, there will be no hit patterns yet in Hit Pattern Array P71, and Routine P87 thus actuates Routine P70, the Instructions For Compiling A New Hit Pattern Element, which, in turn, directs the collection of the previously described data to form the first of a series of hit pattern elements, such as element H-1, in Array P71. Element H1 can begin, for example, with an element identifier as at P74 which has the letter "H" plus a sequential number. These are supplied by Incrementer Routine P72, which retrieves the letter "H" from memory location P73 and takes the Current Hit Pattern Element number from location P66 and increments it by 1 in the Incrementer P65, and combines it with "H", and stores the combination in P74, which is the first field of the Hit Pattern being formed. Routine P70 next retrieves from working storage area P48 (FIG. 4) the card number identifier (in this case C50), and the card number (01 in the example) and stores them at locations P75 and P76 respectively in element H1. The Routine P70 retrieves from Game Pattern Array G165 the game pattern element identifier (G30 in the example); the game number (06 in the example); the total patterns (4 in the example); the pattern number (01 in the example), and the Bingo Hit Count for the pattern (5 in the example) and stores them in element H1 at locations P77–P81 respectively. The hit number total is initialized to 1 by Routine P70 and stored in file location P82. The hit coordinates 1;1 are retrieved from memory location P64 and stored in element H1 at location P83, and the hit number (14 in the example) is retrieved from memory location P52 and stored in element H-1 at location P84.

Means is also provided to add the hit coordinates and hit number to an existing element when the hit occurs in a pattern that already has one or more hits. For example, assume that the next number called is "8", entered as 08 (FIG. 4). The number is processed as previously described, and found to be a number identity which number, 08, is stored in temporary storage P52 (FIG. 4B) and a pattern hit, at coordinates 1;2, which coordinates are stored in temporary storage P64. The Pattern Identifier is then fed into Comparator P69. When Scanner Routines P85 and P86 (FIG. 4B) scan Hit Pattern Array P71 to feed the Pattern Identifiers of Hit Patterns already in progress, one of the pattern identifiers fed into Comparator P69 will be Pattern Identifier G30, and an equality will thus be detected by the Comparator, since pattern G30 has already been hit, and thus a Hit Pattern Element already exists for it. As a result of the equality, a signal is given to Routine P88, the Instructions To Add To An Existing Hit Pattern Element which are the instructions to add to an existing hit pattern. Routine P89 activates Routine P100, the Instructions to Feed the Current Coordinates from P64 (coordinates 1, 2 in the example) to the Address Allocator Routine P103, and also activates Routine P100, the Instructions to Feed the Current Hit Number from P52 (number 08 in the example) to the Address Allocator Routine P103, and also activates Routine P102, the Instructions to Feed the Pattern Indentifier from P68 to the Address Allocator Routine P103, which adds the hit coordinates (1;2) and hit number (08) to the next available storage location P111 and P112 respectively, in the Hit element (Element H-1 in the example).

In order to provide a basis for checking for an alert or bingo situation, means is provided for the hit count of a pattern to be imcremented by 1, each time a pattern hit occurs. For example, Routine P87 activates Routine P93, the Instructions to Increment the Hit Count, which obtains the current hit count from P82 and feeds it into incrementer P118 where it is incremented by 1 and then places the new count back in field P82.

Since all the game patterns on each card must be checked for hits, means are provided to repeat the search for a hit on the next game pattern of the card being examined, until all of the patterns in the card have been examined. For example, when Routine P70 has completed its compilation of the current Hit Pattern, based upon its examination of game pattern no. 1, it then activates Routine P90, the Next Pattern Repeat Instructions, to compare the hit number (in this case no. 14) to the next game pattern (which would be pattern no. 2) to see if the "Number Identity" constitutes a "Pattern Hit" for the next pattern in the game selected. To implement this, Routine P90 activates Routine P91, the Instructions For Determining If Any Patterns Remain, to retrieve the total number of patterns for the selected game Memory Location P79 (4 Patterns in the example) and the current pattern number from location P80 and feeds them into a Comparator P92. If the number of patterns examined is less than the number of patterns for the game, the Comparator gives off a signal which initiates Routine P94, the Instructions To Repeat Routine P54 (FIG. 4B) for the next pattern, with each new hit pattern found being stored in Hit Pattern Array P71.

Thus, when Pattern No. 2 has been examined, and the hit, if any recorded, the comparison in Comparator P92 shows that the pattern comparison is not complete, and gives off a signal to Routine P94 to repeat the process. This comparison and repeat continues until pattern Numbers 3 and 4 are similarly examined.

Thus, the repeating process continues until the number of patterns examined equals the number of patterns for the game, at which point a signal is given off by the Comparator P92, which actuates Routine P95, the Next Card Repeat Instructions. Routine P95 activates Routine 96, the Instructions for Determining if any Cards Remain. Routine P96 retrieves the total cards located, from memory location C16 in FIG. 2, and also retrieves the number of the card just examined, from memory location P76 (in the example, 1) and feeds both numbers into a Comparator P98.

When the number of cards examined is less than the number of cards loaded, the Comparator P98 gives off a signal to activate Routine P99, the Instructions to Repeat Routine P40 to compare the called number (no. 14 in the example) to the next card for all the patterns, if any, is given the next Hit Pattern number, Hn (not shown), and stored in Hit Pattern Array P71 in the same manner that Hit Pattern element H1 was stored. The process is continued until the number of cards examined equals the number of cards loaded, at which point a signal is given off by Comparator P80 to initiate Routine P105, the Bingo Search, wherein each of the hit card patterns stored in Hit Pattern Array P71 are examined as hereinafter described to determine if a Bingo has occurred.

Assume that the entry of the first number (no. 14 in the example) does not reveal a bingo on any card. The Routine P105 will then automatically activate Routine P106, the Alert Search Instructions to see if any selected Alert situation exists, (i.e., whether any pattern of any card has the selected number of hits less than that required for Bingo in that pattern) the exact number less than bingo being determined by the type of Alert selected by the player, as described hereinafter.

If neither the Bingo search, nor the Alert search shows that the introduction of the entered number (number 14 in the examples) has produced a Bingo or an Alert situation, then the device is ready to receive the next called number. In order to apprise the player of this condition, means is provided to indicate that the device is ready to receive the next called number. This could be accomplished, for example, by Routine P106 activating Routine P107, the Instructions for receipt of the next number called. Routine P107, in turn, activates Routine P108, the Instructions to Clear the Screen of the Entered Called Number. Routine P108 then clears the screen by activating the Erase Instructions P22 to turn off the LCDs indicated by the Coordinate Allocator P33. On observing the entered number disappear, the player knows that the device has completed its search, and he can listen for and enter the next number called by the M.C. Routine P107 returns control to Routine P11, and the player can then proceed with the input of the next called number.

Alert Search

The previously described process will continue for each entered number. Assume that many numbers, including numbers 14, 22, 37, 52, and 72 have been entered. Assume further that a search for Bingo by Routine P105 (by a method described later) does not indicate that any Bingo is present, and that thus, the Alert Search, Routine P106 is activated.

In accordance with the invention, alert means is provided to search the Hit Patterns to determine which Hit Patterns, if any, have a preselected value less than Bingo. In the embodiment shown, means is provided to examine the hit patterns to search for the difference between the bingo count for the pattern, and the hit count for the pattern. This could be accomplished, for example, by Routine P106, the Instructions for Alert Search activating Routine P120, the Instructions for Examining Hit Patterns for Alert, which could activate Scanner Routine P124 and Indexer P153 which feed the bingo count from the bingo count field (fields P81A–P81D in the example) and the actual hit count from the hit count field, (fields P82A–P82D in the example) into a Comparator P125, which outputs the difference between the input numbers, and feeds the difference to a Routing Routine P154 which triggers the appropriate switch to turn on the light associated with the switch. In the example, switch P152 turns on the blue light B15 when the output of Comparator P125 is 4; switch P151 turns on the green light B16 when the Comparator output is 3, switch P150 turns on the orange light B17 when the Comparator output is 2; and switch P149 turns on the yellow light B18 when the Comparator output is 1.

In the embodiment shown, the player decides which lights he wants to have activated. For example, some players may want to be alerted to their entire progress, while others may want to be alerted only when one or two hits away from a bingo. In order to make this selection, the player merely turns the dial B20 (FIG. 1) to the numbers 1 to 4 (such numbers being representative of bingo minus 4 to bingo minus 1. As an example, assume that the player wants to be progressively alerted from bingo minus 4 to a bingo minus 1 condition. He merely turns the dial to 4. The activates Routine P145, the Instructions to Activate switches 4 to 1. Routine P145 activates switches P149 to P152 so that they may close to light their corresponding lamps upon receipt of an instruction from Routing Routine P154. Similarly, Routine P146, the Instructions to Activate switches 3 to 1, will enable only the green, orange and yellow lamps to light. Routine P147, the Instructions to Activate switches 2 to 1, will enable only the orange and yellow lamps to light. Routine P148, the instructions to activate switch 1, will enable only the yellow alert lamp to light.

In addition to providing a visual indication means for indicating that a bingo minus one alert is present, means is also provided for determining the potentially hittable number or numbers, any one of which remains to be hit for any Hit Pattern to constitute a bingo. In this manner, the player has the thrill of "anticipation" which he would have if he were looking at the actual cards and determining what number is needed for bingo.

An example of one way of providing the means for indicating what numeral is needed for a bingo, is by actuating a routine, such as Routine P128, the Instructions for Locating the Number Needed for a Bingo, which actuates Routine P129, the Instructions to Place the Hit Pattern In A Working Array, and then compare the coordinates of the Hit Pattern to all the coordinates of the programmed pattern to which the Hit Pattern belongs to determine which square has not yet been hit. For example, Routine P129 would retrieve from the Scanner Routine P124, the hit pattern which has an alert (Pattern H-2 in the example) and place such pattern in the working memory P130. Routine P128 could then actuate Routine P134, the Instructions for Locating the Unhit Coordinate in the Pattern which, in turn, would actuate the routine P138, the Instructions to Feed the Game Pattern Coordinates into the Comparator, which would cause the Coordinate Scanner Routine P135 to sequentially retrieve the hit coordinates from the register, in this case the coordinates from pattern no. 1, game no. 1, and feed them into the Coordinate Comparator P137.

As each hit coordinate is fed into the Coordinate Comparator and retained for comparison, Routine P138 also feeds into the Comparator all of the coordinates (hit or unhit) which make up that game pattern. For example, Routine P134 would also actuate Routine P310, the Instructions To Place All The Coordinates Of The Game Pattern Into The Working Area P140 which, to carry this out, would activate Routine P313. The instructions to retrieve the Pattern Identifier from P130 and retrieve the coordinates associated with said Pattern Identifier from Storage at G165 and place the coordinates in Working Area P140. Routine P134 would then activate Routine P138, the Instructions to Feed Game Pattern Coordinates into the Comparator. These instructions would, in turn, activate a Coordinate Scanner Routine P144 which would then sequentially feed all the coordinates of the pattern into the Coordinate Comparator P137, one at a time, to compare them to each coordinate fed in from the Hit Pattern. If one of the coordinates of the game pattern equals the coordinates from the Hit Pattern, the Coordinate Comparator P137 gives off a signal to coordinate Scanner Routine P135 to increment to the next coordinate of the scanned pattern.

If one of the coordinates from the Scanner Register P135 is not matched by any of the coordinates fed from the Scanner Register P140, this is the missing coordinate, and the coordinate comparator will pass this coordinate on to a storage location such as P145. The coordinate comparator P137 will also give off a signal to locate such coordinates on the card being examined. The means could be the actuation of a routine such as P148, the Instructions for Locating the Unhit Number on the Card, which would, in turn, actuate Routine P149, the Instructions for Feeding the Card Coordinates into a Comparator to Locate the Unhit Coordinates on the Card. For example, Routine P149 could retrieve the card from its memory location, in this case location C38, and actuate Scanner Routine P154 which sequentially feeds the coordinates from the card into Comparator P151. Routine P150, the Instructions for Feeding the Unhit Pattern Coordinates Into a Comparator had fed the unhit coordinate, in this case, 2, 1 from its memory location P145 into Comparator P151. When an identity exists, Comparator P151 gives off a signal to Routine P156, the Instructions for Storing the No. which is Located at the Unhit Coordinate. Routine P156 searches the card C50 to locate the numeral located at the unhit coordinates, in the example, it is the numeral stored adjacent the coordinate.

Means is then provided to display the unhit numeral necessary to constitute a bingo in the column to which such numeral is allocated by the rules of bingo. In the preferred embodiment, the first unhit number is displayed at the bottom row of the display means so that it can readily be seen by the player. When the next pattern has an alert situation, if the alert is in the same column, i.e. associated with the same letter, then the next number is displayed in the next row above. By such means, the player can have a constant display of numbers needed, any one of which will constitute a bingo, so that the player can cheer, or await the anxious expectation for one of the displayed numbers to be called, thus increasing the excitement of the game.

One way of providing this display is for routine P106 to then actuate Routine P158, the Instructions For Locating Column Number In Memory Matrix Assigned To The Number, which actuates a routine, such as Routine P25, FIG. 4-A, which activates Scanner Routines P26 and P27 to scan a column and number matrix and sequentilly feed the numbers into a number comparator P30. Routine P158 also feeds the unhit number from its storage location P157 to Number Comparator P30. When an identity is found, the identity of the column number is stored as at storage location P160. Routine P158 then feeds the column number, in this case no. 2, to a Column Allocator routine P164 which locates a column storage location for column 2.

Means is then provided to place the unhit number in such column at the next available row, starting from the bottom. For example, Routine P106 could then actuate Routine P165, the Instructions For Assigning The Unhit Number To The Next Vacant Row Starting At The bottom Of The Matrix, Routine P165 could activate the Row Incrementer Routine For Column 2, P168 which sequentially scans each row from the bottom up to locate a free row. When a free row is located, the identity of the row is stored as at location P169, and the unhit number, in this case 22 from location P157 is stored in the Matrix at the next vacant row which is row 5 of column 2.

Means is then provided for displaying the unhit number in the display grid B5. This could be accomplished by Routine P106 actuating the Instructions For Display Of Unhit Number P174, which actuates the Display Allocator routine P175 which locates the column in memory location P176, and the row in memory location by P169, and then actuates the corresponding column and row display Instructions, in this case, column 2 Row 5 Display Instructions P177. Routine P174 also activates Routine P179, the Number Retrieving Routine, which retrieves the number to be displayed, in this case number 22, from Matrix P170 and transfers it to memory location P178 from which it is retrieved by Routine P177 for display at column 2, row 5, as shown.

Figure 4E:
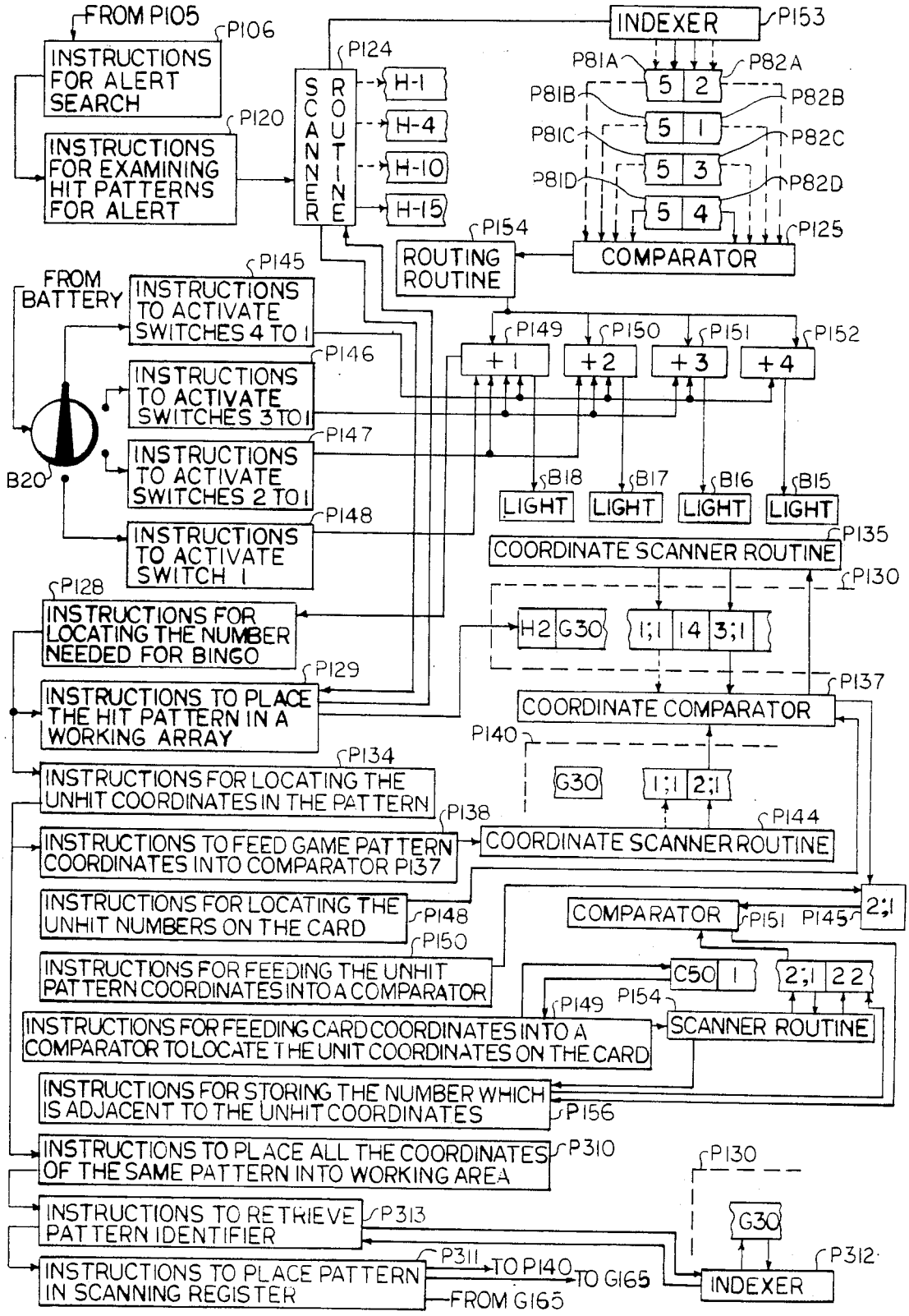
FIG. 4E is a partially fragmentary and partially schematic view illustrating the steps for sequentially lighting the alert lamps, one means to select which of the alert lamps the player wants to have lit; and, for the one-number-short-of-bingo alert, one means of commencing the determination of the number or numbers, any one of which, will constitute a bingo if the number is hit.
Figure 4F:
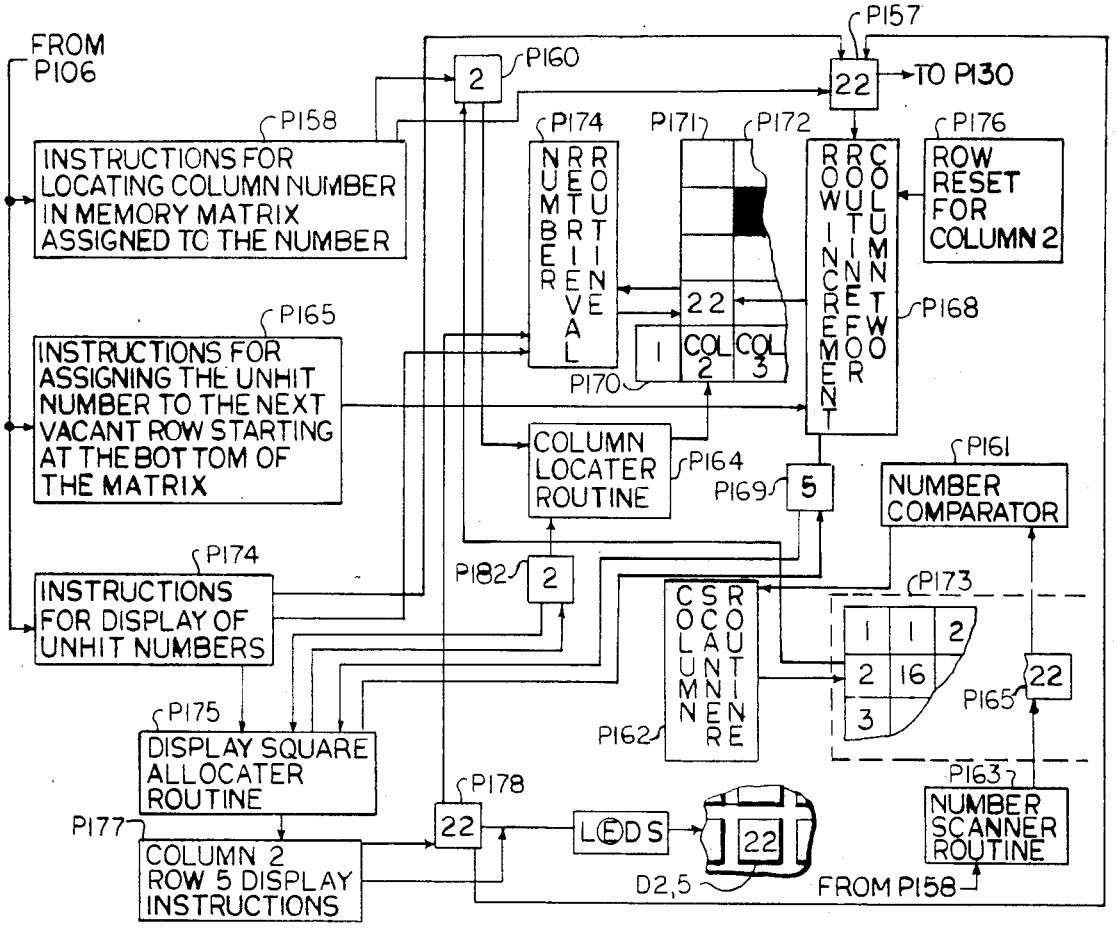
FIG. 4F is a partially fragmentary and partially schematic view illustrating the completion of the determination of the unhit numbers in the one-number-short-of bingo alert status, and the display of one of such numbers.
Figure 4G:
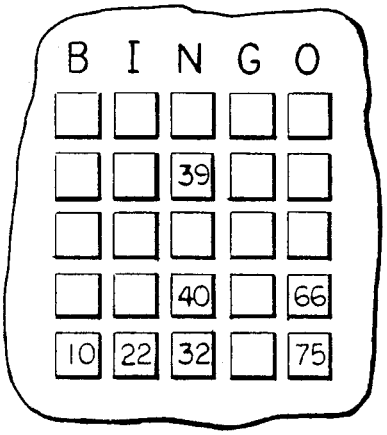
FIG. 4G is a fragmentary top plan view of the display grid, illustrating the display of the numbers in the alert status, any one of which, if called, would constitute a bingo.

The foregoing procedure is repeated for each het pattern which is in an alert situation. For example, as shown in FIG. 4G, assume that seven patterns are in an alert situation, with the patterns needing respectively the numbers 10, 22, 32, 39, 40, 66 and 75 for a bingo. These numbers would be displayed by the foregoing procedure on the display grid B5, as shown.

Means (not shown) would be provided so that the column 3 portion (not shown) of matrix P170 would not have a space at row 3 to receive an alert number, since such space is reserved on the display (space D3, 3) to display the game number, and later the bingo card numbers.

Similarly, all of the columns of matrix P170 omit the top row, as this is the row in which the called number appears before it is entered by the player.

It is to be understood further that in the event that more numbers allocated to a particular column are in the alert situation than there are rows available to display all the numbers, means (not shown) could be provided to assign the additional numbers to another matrix (not shown) and then alternatingly display the numbers appearing in such column in the first matrix and then the numbers appearing in the same column in the second matrix, in alternating sequence.

Means is also provided to determine the progress of any card towards bingo. This may be accomplished, for example, by pressing the Scan Key K19, which, when the device is in Initial play mode and a number, such as 01 has been input by pressing keys K10 and K1, Routing Routine P2 activates Routine P325, the Card Progress Scan Instructions. Routine P325 then activates Routine P330, the Instructions For Locating The Unhit Coordinates In The Next Hit Pattern. Such instructions locate the unhit card coordinates for the card indicated by the input keys (in this case K10 and K1) in a manner comparable to that performed in the Alert Search by Routine P134 (FIG. 4E) for locating similar coordinates, except that in the present scanning operation, each pattern for the game will be fed into a comparator, as well as, each hit pattern which identifies called card.

Routine 336, the Instructions For Locating The Unhit Numbers On The Card then locates the unhit numbers and their coordinates in a manner comparable to that performed in the Alert Serach by Routine P148, except that usually more than one number will be unhit.

The unhit numbers are displayed by the actuation of Routine P340, the Instructions To Apply The Unhit Numbers At Thier Coordinates in a manner involving a coordinate allocator, as described previously herein.

Bingo Search

In the preferred embodiment, means are provided to detect when bingo occurs on any card. The presence of a bingo will be detected by the Instructions For A Bingo Search P105, which, as mentioned, is actuated after the current called number is compared to all the patterns for all the cards and all the hits are recorded.

One way of accomplishing this is for each Hit pattern to be examined to determine whether the entry of the current called number has caused any of the Hit Patterns to achieve the number of hits to constitute a Bingo. For example, since each Hit Pattern record includes the number of hits which constitute a bingo for the pattern, as well as the current status of hits for such pattern, a comparison of these two numbers for each pattern will determine which patterns have a bingo.

An example of one way of commencing the carrying out of this procedure would be for Routine P105 to actuate a Routine P200, Instructions For Examining The Hit Patterns For Bingo, which, in turn, would activate a Scanner Routine P204 to sequentially scan each of the Hit patterns in memory location P71 to extract the bingo count for each pattern from its memory location, such as P81B of Hit Pattern H-2, and the current hit count for the same hit pattern from its memory location, such as P82B of Hit pattern H-2, and feed them into a Comparator P205. Each time an equality exists between the bingo count and the current hit count for a hit pattern, it means that such hit pattern has a bingo, and Comparator P205 indicates this by emitting a signal. In the embodiment shown, all hit patterns are searched before the device informs the player of the existance of a Bingo. Accordingly, the signal from Comparator P205 activates Routine P206, the Instructions to store Bingo Hit Patterns until all Hit Patterns are searched, which routine removes the Bingo Hit pattern from storage Location P71 and stores it in a Bingo Pattern Storage Location P207, where each Bingo Pattern is stored until all the Hit Patterns have been examined for a Bingo.

One way of determining that all the Hit Patterns have been examined would be for Routine P204 to emit a signal to a Counter P203 each time that Scanner Routine P204 begins examining a pattern. The output of Counter P203 could then be fed into a Comparator P208 which is also fed the total number of Hit Patterns which have been stored in location P71, which could be established by counting the hit patterns, as by a counter P97 (FIG. 4B) which is incremented each time Routine P70 compiles a new hit file in Storage Location P71. When the number of the Hit Patterns scanned for a bingo equals the number of Hit Patterns stored in Storage Area P71, the scanning is complete, and Comparator P208 indicates this by emitting a signal to the Routing Routine P209, which then enables the Routine P105 to actuate the routines for indicating that a bingo has occurred, and on which cards.

Routine P105 then activates Routine P215, the Instructions to Display the Word, "BINGO". These instructions activate the Window Display Instructions P4 to retrieve the word, BINGO, from its memory location P216, and cause the Window LCDs P7 to display the word, BINGO, in the window W.

Routine P105 also gives a signal to Routine P220, the Instructions For Flashing Light which actuates the alternating switch P221 to cause the red light B8 to flash on and off to further catch the player's attention.

Means is provided to determine which cards have a bingo, as well as the winning bingo pattern for each card. The player initiates such action by pressing a Scan Key K19 which causes the number of the first winning card to be displayed in the center square, and the winning pattern to be displayed on the display grid in the same location in which it appears on the actual card, so that the player can mark his actual card in accordance with the displayed pattern. In the embodiment shown in FIG. 4H, when the Scan Key K19 is pressed when the device is in the play mode and a Bingo has been detected, Routing Routine P315 activates Routine P225, the Instructions to Display the Number of the Next Card having Bingo. One way of accomplishing this is for Routine P225 to actuate the Scanner Routine P226 to index the hit patterns to feed the first card number to the Center Square Display Instructions P16, and thus to the LCDs P17, to provide a display of the first winning card number.

Means is also provided for the player to determine the winning pattern. Accordingly, each time the Scan Key is pressed, a winning pattern is displayed. For example, pressing the Scan Key K19 causes Routing Routines P315 to activate Routine P244 the Instructions to Display a Winning Pattern to activate Routine P317, the Instructions to retrieve the next Hit Pattern and place in Scanning Working Area. Routine P317 then activates scanner routine P226 to point at the next hit pattern (the first pattern when the Scan Key K19 has been pressed for the first time in storage area P207), retrieves such pattern and places it in working storage area P250. Routine P244 then activates the Display Instruction Allocator P252, which retrieves the numbers of the bingo pattern and feeds them to the appropriate LCDs (not shown), which correspond to the coordinates for such pattern. By the foregoing means, a display of the winning pattern and the card number on which it appears is provided. For example, Card No. 1, having the winning pattern B14, I22, N37, G52, and O72 is shown in the display grid B5 in FIG. 4H.

If more than one card has a bingo, means is provided to indicate to the player that such card is not the only card having a bingo. This is accomplished by having the displayed card number flash. One means of sensing that more than one card has been hit, is for counter P278 to be incremented each time that a hit pattern is stored in storage area P207. Similarly, each time that Routine P226 indexes to a Hit Pattern, a counter P229 could be incremented. These numbers are then fed into the Comparator P230. When the numbers are equal, a signal is given to Routine P251, the Instruction To Flash The 3;3 Number In The Center Square. If more than one bingo exists, as a result, the player knows that he must press the Scan Key again to find out what other card has a bingo. This activates Routine P317 to remove the next bingo pattern from storage P207, and such pattern, together with the card number for the pattern is displayed as previously described. As an example, when the Scan key is pressed a second time, card number 9 appears in the center square, and the pattern is displayed as at P320.

When all of the bingo patterns from Register P207 have been scanned, the numbers will continue to flash, and when the Scan Key K20 is pressed again, the patterns and numbers will be repeated in the event the player wants to double check.

Figure 4H:
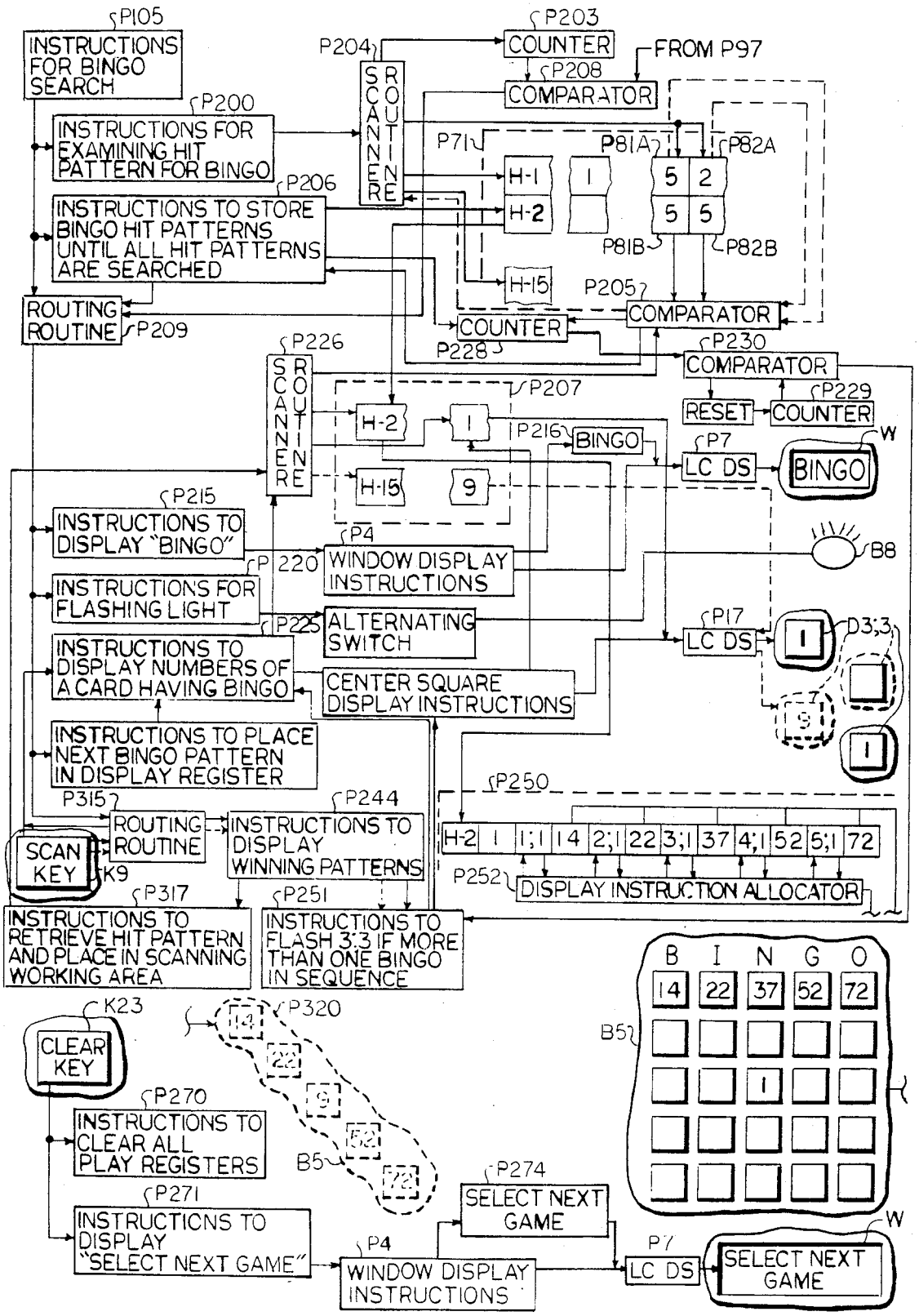
FIG. 4H is a partially fragmentary and partially schematic view illustrating the operations of a bingo search, illustrating the display of the word, bingo, the lighting of the bingo lamp, the display of winning, card numbers and patterns.

The player then prepares for the next game by pressing the Clear Key K23, as shown in FIG. 4H. When the clear key K23 is pressed, it activates the routine P270, instructions to clear all play registers. It then activates P271, instructions to display "Select Next Game" which activates the window display instructions P4, whcih retrieves "Select Next Game" out of memory location P274 and then activates LCDs P7 to display "Select Next Game" in Window W.

It is to be understood that means (not shown) is provided, as is well known in the art whereby similar clearing and/or resetting will occur when the device is switched from one mode to another, such as from Program to Play, but not when switched into and out of Scan, except as applicable to the Scan mode.

Figure 6:
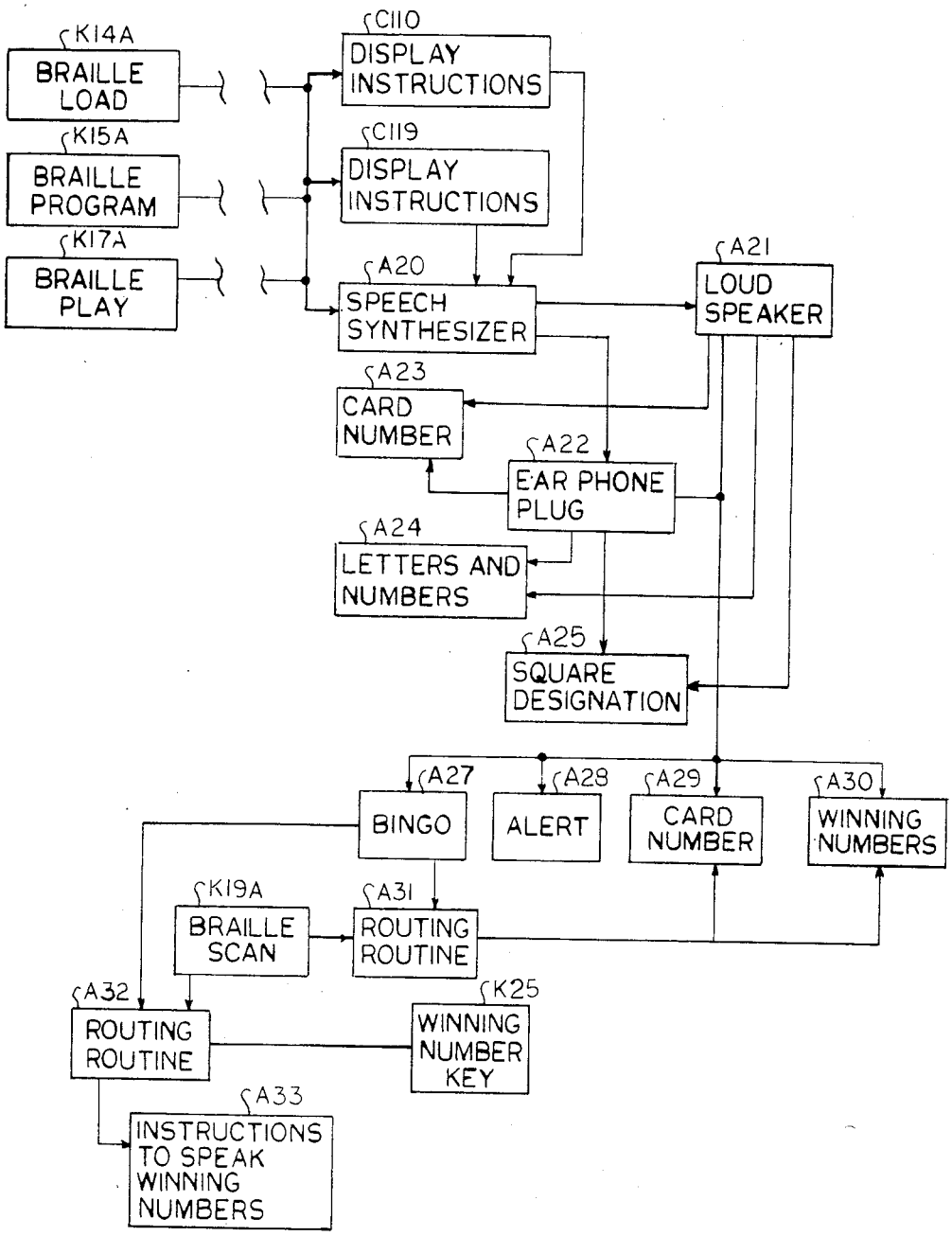
FIG. 6 is an illustration of a voice synthesized output.

In order for the device to be used by the blind, a voice synthesizer can be provided (FIG. 6) which would output at least some of the same information as the visual display, but in humanly intelligible sounds. As shown, the input keys such as the Load, K14A, the Program K15A and the Play K17A Keys, and the number Keyboard, such as "No. 1", K1A are in Braille. The input keys, except for also having Braille written thereon are identical in output to the keys described in connection with the main embodiment.

The display instructions would not only provide visual display, but in some cases, also synthesize information for speech. In the Load Mode, such information such as the card number, the column Letter "B,I,N,G,O", input number, and any informaton normally displayed in the window. For example, when a Braille program K14A–K17A key is pressed the general display instruction C110 branch out to the display instruction C119, and to the speech sythesizer A20. The synthesizer then sends a signal to either the loud speaker A21, or the earphone A22 which then verbally states, depending upon the situation, the card number (A23) letters and numbers (A24) or square designation (A25). Similarly, words such as "BINGO" A27, "ALERT" A28, could be spoken and other information such as the card number (A29). When in play, and a Bingo is reached, the word "BINGO" A27 is spoken and when scan key K19A is pressed, the card number A29 is spoken. When the winning number key K29 is pressed, the instructions to speak the winning numbers and their coordinates are activated.

Figure 5:
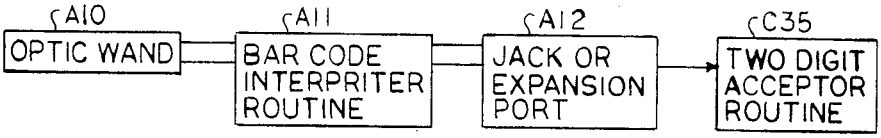
FIG. 5 is a schematic drawing of an optic wand input means.

In further modification of the device, the Loading of the cards could be by a wand (not shown) such as is used with cash register entry (FIG. 5), and each of the cards could have a bar code on each of the numbers so that the machine would enter and display the numbers by the player merely running the wand down the columns of the coded cards. The device would have circuitry and programming (not shown) but well known in the art for converting such bar code entries into digital entries fo processing thereafter in accordance with the previously described techniques of this Application. With the device in the load mode, connecting the OPTIC wand jack to the terminal interface connection (not illustrated at body B1), means would be provided to bypass manual input routines and translate the bar code into binery input information directly into permanent storage location G165.

In still another modification, when the M.C. pulls the called numbers at random, he could place this number on a device (not shown) which would send a code to the machine to make entries, so that there would be a perfect correspondence between the number called and entered. For example, the objects on which the called numbers appear could have a bar code which is read by the device on which the objects having the called number is placed, and the numbers could then be transmitted to the devices of the invention, which would be modified to have input jacks and circuitry (not shown) to receive such input.

What is claimed is:

1. A game device for playing more than one bingo card at a time, comprising container means, computer means mounted in said container means, visual display means mounted on said container means and operably connected to said computer means, a plurality of manually actuated numerical input keys to input into the computer means representations of a plurality of numbers appearing on a 5×5 matrix of each bingo card to be played, means in said computer means to assign each of said numbers its relative spatial location in its 5×5 matrix based upon the relative time sequence of input of said numbers and to cause said display means to display said plurality of numbers in the same spatial orientation which they occupied on the card from which they were input, means to selectively input into said computer means a plurality of spatially oriented bingo patterns by pressing those portions of the display means which spatially define each pattern, means to select at least one of the input patterns for the game to be played, means in said computer means to determine which of said plurality of numbers for each card are within a selected pattern for the game to be played, means to input a series of random numbers, one at a time, and to compare for each card each random number with those of said plurality of numbers which are within a pattern of the game selected to be played to at least determine and identify on which cards a bingo exists for a pattern selected for the game to be played.

2. A device in accordance with claim 1 wherein, each of said random numbers are displayed in columns which correspond to the column to which the number is allocated by the rules of bingo.

3. A device in accordance with claim 1 including, means to display the numbers which constitute a winning bingo pattern for each card having a bingo pattern.

4. A device in accordance with claim 3 wherein, said plurality numbers which constitute said winning bingo pattern are displayed in the same location in which they appeared on the card from which said numbers were input.

5. A device in accordance with claim 1 including, means in said computer means to determine, as each random number is entered, whether the input of a random number causes any of said plurality of numbers on any card to constitute the remaining one of the plurality of numbers, within a pattern of the game selected to be played, which is necessary to constitute a bingo for the pattern, and means in said computer means to cause said display means to cumulatively display each of the remaining ones of the plurality of numbers, any one of which, if matched by a subsequently entered random number, would constitute a bingo for a pattern.

6. A device in accordance with claim 5 including, means in said computer means to cause said display means to display said remaining ones of the plurality of numbers in columns to which the numbers are assigned by the rules of bingo.

* * * * *